US008000636B2

(12) United States Patent
Sano

(10) Patent No.: US 8,000,636 B2
(45) Date of Patent: Aug. 16, 2011

(54) PARTICLE SUPPLY APPARATUS, IMAGING APPARATUS, AND PARTICLE ACCOMMODATING UNIT TRANSPORTING METHOD

(75) Inventor: Hiroshi Sano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 369 days.

(21) Appl. No.: 12/018,611

(22) Filed: Jan. 23, 2008

(65) Prior Publication Data

US 2008/0213003 A1 Sep. 4, 2008

(30) Foreign Application Priority Data

Jan. 25, 2007 (JP) ..... 2007-015208

(51) Int. Cl.
*G03G 15/08* (2006.01)
*G03G 15/00* (2006.01)

(52) U.S. Cl. ..... 399/258; 399/120; 399/252; 222/195; 222/630

(58) Field of Classification Search ..... 399/119, 399/120, 252, 258, 260, 262; 222/195, 630
See application file for complete search history.

(56) References Cited

U.S. PATENT DOCUMENTS 5,950,055 A 9/1999 Yahata et al.
5,950,062 A 9/1999 Yahata et al.
6,201,941 B1 3/2001 Kasahara et al.
6,393,241 B1 5/2002 Matsumoto et al.
6,501,913 B2 12/2002 Hattori et al.
6,577,842 B2 6/2003 Akiba et al.
6,591,077 B2 7/2003 Yanagisawa et al.
6,628,908 B2 9/2003 Matsumoto et al.
6,648,029 B1 11/2003 Amano
6,665,508 B2 12/2003 Sudo et al.
6,679,301 B2 1/2004 Makino et al.
6,775,503 B2 8/2004 Hattori et al.
6,826,381 B2 11/2004 Muramatsu et al.
6,859,634 B2 2/2005 Itoh et al.

(Continued)

FOREIGN PATENT DOCUMENTS

EP 1 695 924 A1 8/2006

(Continued)

OTHER PUBLICATIONS

Japanese Office Action issued May 2, 2011 in Japanese Patent Application No. 2007-015208 filed Jan. 25, 2007, 2 pages.

*Primary Examiner* — David P Porta
*Assistant Examiner* — Jessica L Eley
(74) *Attorney, Agent, or Firm* — Oblon, Spivak, McClelland, Maier & Neustadt, L.L.P.

(57) ABSTRACT

A particle supply apparatus for supplying particles to a supply destination is disclosed that includes a particle supply apparatus main frame, a particle accommodating unit that accommodates the particles, a gas spouting unit that is arranged at a bottom portion of the particle accommodating unit and is configured to spout gas toward the particles, and a conveying mechanism that applies suction to the particles accommodated in the particle accommodating unit and conveys the particles toward the supply destination. The particle accommodating unit is installed in the particle supply apparatus main frame and is arranged to rest on a face at the bottom portion side during operation, and the particle accommodating unit is detached from the particle supply apparatus main frame and is arranged to rest on a face other than the face at the bottom portion side during transportation.

19 Claims, 13 Drawing Sheets

U.S. PATENT DOCUMENTS

| | | | | |
|---|---|---|---|---|
| 6,863,096 | B2 | 3/2005 | Amano | |
| 6,874,546 | B2 | 4/2005 | Amano et al. | |
| 6,981,530 | B2 | 1/2006 | Amano et al. | |
| 7,017,625 | B2 | 3/2006 | Amano et al. | |
| 7,283,772 | B2 | 10/2007 | Amano et al. | |
| 2004/0037591 | A1 * | 2/2004 | Schlageter et al. | 399/258 |
| 2005/0244193 | A1 * | 11/2005 | Amano et al. | 399/258 |
| 2007/0157990 | A1 | 7/2007 | Amano | |
| 2007/0201904 | A1 | 8/2007 | Sano et al. | |
| 2007/0201905 | A1 | 8/2007 | Sano et al. | |
| 2007/0212117 | A1 | 9/2007 | Itoh et al. | |
| 2007/0242983 | A1 | 10/2007 | Sano | |

FOREIGN PATENT DOCUMENTS

| | | |
|---|---|---|
| JP | 4-34480 | 2/1992 |
| JP | 09-311553 | 12/1997 |
| JP | 11-52695 | 2/1999 |
| JP | 2000-19830 | 1/2000 |
| JP | 2000-194182 | 7/2000 |
| JP | 2001-175070 | 6/2001 |
| JP | 3534159 | 3/2004 |
| JP | 3549051 | 4/2004 |
| JP | 2005-24622 | 1/2005 |
| JP | 2005-215655 | 8/2005 |
| JP | 2005-292300 | 10/2005 |
| JP | 2006-47972 | 2/2006 |
| JP | 2006-48009 | 2/2006 |
| JP | 2006-48010 | 2/2006 |
| JP | 2006-098491 | 4/2006 |
| JP | 2006-106425 | 4/2006 |

* cited by examiner

PARTICLE SUPPLY APPARATUS, IMAGING APPARATUS, AND PARTICLE ACCOMMODATING UNIT TRANSPORTING METHOD

BACKGROUND OF THE INVENTION

1. Field of the Invention

The present invention relates to a particle supply apparatus that supplies particles such as toner to a supply destination; an electrophotographic imaging apparatus such as a copier, a printer, a facsimile machine, or a multifunction machine; and a method of transporting a particle accommodating unit that is detachably installed to the particle supply apparatus.

2. Description of the Related Art

Technology related to a particle supply apparatus such as a toner bank or a toner replenishing apparatus used for accommodating large amounts of toner in an imaging apparatus such as a copier or a printer are disclosed in Japanese Patent No. 3534159 and Japanese Laid-Open Patent Publication No. 2005-24622, for example.

In Japanese Patent No. 3534159, a particle supply apparatus (toner bank) that can accommodate plural toner container bottles is disclosed. Specifically, according to this disclosure, a stopper of one of the plural toner containers is removed so that toner contained therein may be supplied to a hopper of the toner bank. The toner within the hopper of the toner bank is conveyed to a developing apparatus corresponding to a toner supply destination by gas flow transferring means. Then, when the opened toner container becomes empty, another toner container is opened and toner is supplied from this other toner container to the toner bank.

In Japanese Laid-Open Patent Publication No. 2005-24622, a particle supply apparatus (toner replenishing apparatus) that includes a hopper (toner hopper) having a larger capacity than a toner container is disclosed. Specifically, according to this disclosure, toner from plural toner containers is accommodated within a toner hopper having a large capacity. The hopper has a stirring member that stirs the toner accommodated therein. The toner within the hopper is discharged from the lower side of the hopper and is conveyed toward a developing apparatus corresponding to the toner supply destination by fluid transporting means.

Also, Japanese Patent No. 3549051 discloses a particle supply apparatus (replenishing apparatus) for replenishing toner (particles) in a toner container (particle container). Specifically, according to this disclosure, air is supplied to the replenishing apparatus in order to increase the internal pressure of the apparatus so that toner accommodated within the replenishing apparatus may be discharged from a particle emission tube and supplied to a toner container corresponding to a toner supply destination.

The particle supply apparatus disclosed in Japanese Patent No. 3534159 accommodates plural toner containers in order to increase its toner accommodating capacity. However, when all the toner contained in the plural toner containers are used up, plural replacement toner containers have to be reinstalled into the apparatus which may be quite burdensome. In this respect, although toner accommodating capacity may be increased in the particle supply apparatus, operations required after all the toner is used up may be rather inefficient according to this technique.

The particle supply apparatus disclosed in Japanese Laid-Open Patent Publication No. 2005-24622 increases the toner accommodating capacity by increasing the capacity of the hopper. However, according to this technique, the toner accommodated in the hopper is mechanically stirred by a stirring member in order to prevent cross-linking of the toner, and as a result, mechanical stress may occur in the toner. When mechanical stress occurs in the toner, additives mixed to the toner may emerge onto the toner surface and/or be separated from the toner so that the toner may be degraded to cause image quality degradation. Further, since the particle supply apparatus of Japanese Laid-Open Patent Publication No. 2005-24622 discharges toner from the lower side of the hopper, the toner scattering amount from the particle supply apparatus may be increased when the seal around the toner discharge outlet is degraded, for example.

The particle supply apparatus disclosed in Japanese Patent No. 3549051 actively applies pressure to an accommodating portion that accommodates toner in order to enable discharge of the toner. Accordingly, the accommodating portion has to have adequate mechanical durability for withstanding the pressure applied thereto. In this respect, although the particle supply apparatus according to this technique may be used as a fabricating apparatus that replenishes toner to a toner container, it may not be suitable for use as a particle supply apparatus of an imaging apparatus that supplies toner to a developing apparatus.

Also, it is noted that in the case of using the technique of actively applying pressure to the toner accommodating portion to discharge the toner from the accommodating portion, the discharge amount of toner may vary significantly depending on the amount of toner remaining in the accommodating portion, and it may be difficult to perform fine adjustment of the toner discharge amount. Thus, although the particle supply apparatus of Japanese Patent No. 3549051 may be used as a fabricating apparatus that replenishes toner to a toner container, it may not be suitable for use as a particle supply apparatus of an imaging apparatus that supplies toner to a developing apparatus.

It is noted that the problems described above are not merely problems encountered by a particle supply apparatus used in an imaging apparatus. That is, the problems are common to all types of particle supply apparatuses that demands fine adjustment of the particle supply amount without damaging the particles.

Also, for such particle supply apparatuses, a technique is in demand for efficiently and accurately supplying particles accommodated in a particle accommodating unit to a supply destination and efficiently performing toner replenishing operations (exchange operations) for the particle accommodating unit. Further, a technique is in demand for preventing blocking of the particles accommodated within the particle accommodating unit at operation start time after the particle accommodating unit is transported.

SUMMARY OF THE INVENTION

According to certain aspects of the present invention, techniques implemented in a particle supply apparatus, an imaging apparatus, and a particle accommodating unit transporting method are provided for increasing particle accommodating capacity without damaging the particles or requiring burdensome replacement procedures, enabling fine adjustment of the particle supply amount, conveying particles to a particle supply destination in an efficient and accurate manner without causing particle scattering, and preventing blocking of the particles accommodated within a particle accommodating unit at operations start time after the particle accommodating unit is transported.

According to one embodiment of the present invention, a particle supply apparatus is provided that supplies particles to a supply destination, the apparatus including:

a particle supply apparatus main frame;

a particle accommodating unit that accommodates the particles;

a gas spouting unit that is arranged at a bottom portion of the particle accommodating unit and is configured to spout gas toward the particles; and a conveying mechanism that applies suction to the particles accommodated in the particle accommodating unit and conveys the particles toward the supply destination;

wherein the particle accommodating unit is installed in the particle supply apparatus main frame and is arranged to rest on a face at the bottom portion side during operation, and the particle accommodating unit is detached from the particle supply apparatus main frame and is arranged to rest on a face other than the face at the bottom portion side during transportation.

According to another embodiment of the present invention, the particle accommodating unit includes a gas accommodating pouch arranged at the resting face of the particle accommodating unit during transportation, and the gas accommodating pouch is configured to be reduced in volume by evacuating gas contained in the particle accommodating unit during operation.

According to another embodiment of the present invention, an imaging apparatus is provided that includes a particle supply apparatus according to an embodiment of the present invention.

According to another embodiment of the present invention, a method of transporting a particle accommodating unit that is detachably arranged at a particle supply apparatus for supplying particles to a supply destination which particle accommodating unit is configured to accommodate the particles and has a gas spouting unit arranged at a bottom portion for spouting gas towards the particles, the method involving:

arranging the particle accommodating unit to be detached from the particle supply apparatus, and arranging the particle accommodating unit to rest on a face other than a face at the bottom portion side of the particle accommodating unit upon transporting the particle accommodating unit.

Other objects, features and advantages of the present invention will become more apparent from the following detailed description when read in conjunction with the accompanying drawings.

DETAILED DESCRIPTION OF THE PREFERRED EMBODIMENTS

Figure 1:
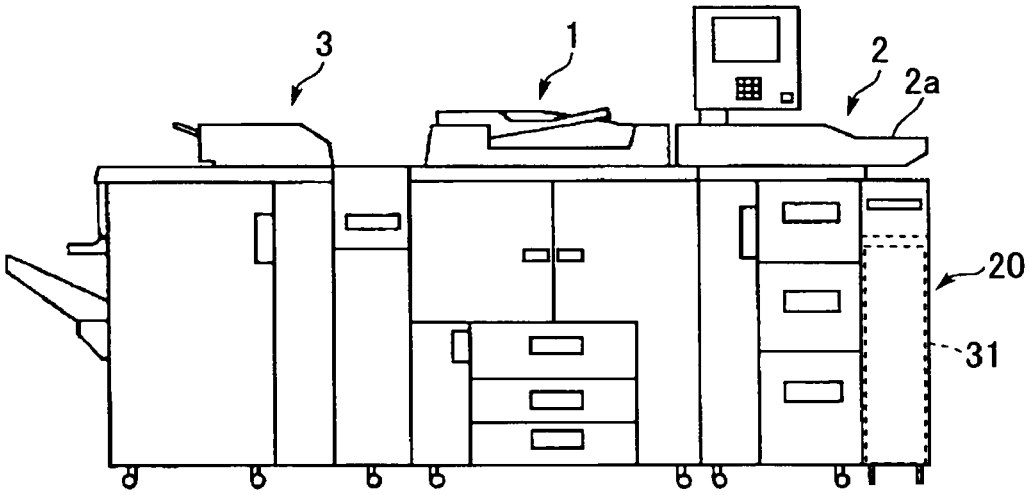
FIG. 1 is a diagram showing an external configuration of an imaging apparatus according to a first embodiment of the present invention.

In the following, preferred embodiments of the present invention are described with reference to the accompanying drawings. It is noted that in these drawings, illustrated elements that have identical or corresponding features are represented by identical reference numerals and overlapping descriptions may be omitted or simplified.

First Embodiment

In the following, a first embodiment of the present invention is described with reference to FIGS. 1-12.

First, the overall configuration and operations of an imaging apparatus according to the first embodiment are described with reference to FIGS. 1 and 2.

FIG. 1 is a diagram illustrating an external configuration of the imaging apparatus according to the first embodiment. FIG. 2 is a diagram illustrating internal configurations of an imaging apparatus main frame and a particle supply apparatus.

In FIG. 1, an imaging apparatus main frame (copying unit) 1, a paper feed bank (paper feed unit) 2, a post process unit 3 that performs post processes such as sorting and stapling, and a particle supply apparatus (toner supply unit) 20 are illustrated as components of the imaging apparatus according to the present embodiment.

The particle supply apparatus 20 is arranged at the bottom side of a wing 2*a* of a paper feed tray that is placed on top of the paper feed bank 2.

Figure 2:
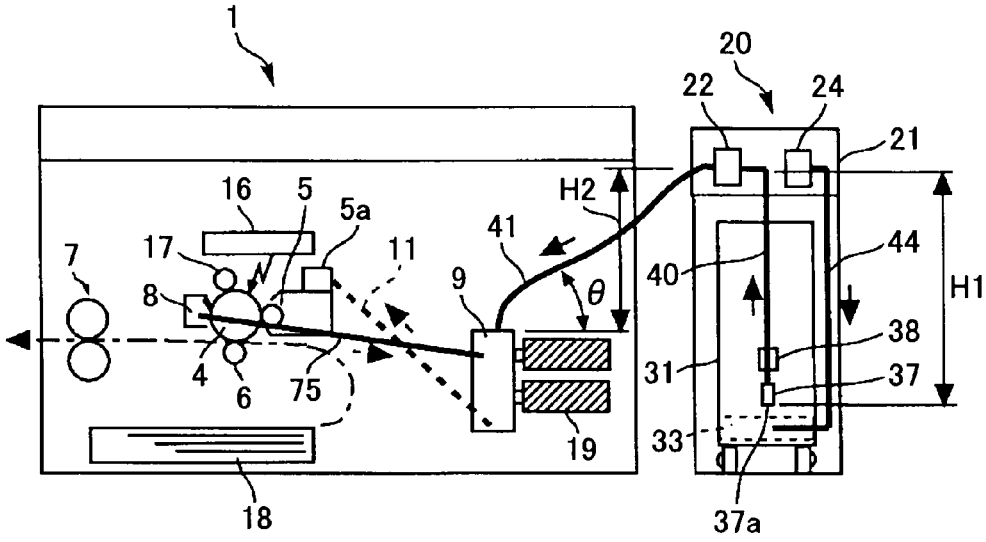
FIG. 2 is a diagram showing configurations of an imaging apparatus main frame and a particle supply apparatus according to the first embodiment.

In FIG. 2, the internal configurations of the imaging apparatus main frame 1 and the particle supply apparatus 20 are shown. Specifically, the imaging apparatus main frame 1 includes a photoconductor drum 4 as an image carrying element, a developing unit (developer) 5 that develops a latent image formed on the photoconductor drum 4, a transfer unit 6 that transfers a toner image formed on the photoconductor drum 4 onto a recording medium such as paper, a fixing unit 7 that fixes toner that is transferred onto the recording medium, a cleaning unit 8 that collects untransferred toner that is remaining on the photoconductor drum 4, an exposure unit 16 that irradiates exposure light on the photoconductor drum 4 based on image information read by a document read unit, a charge unit 17 that charges the surface of the photoconductor drum 4, and a paper feed unit 18 that accommodates recording medium such as paper.

The imaging apparatus main frame 1 also includes a toner hopper (toner receiving unit) 9 as a supply destination for the toner being supplied from the particle supply apparatus 20, a toner conveying channel 11 for conveying the toner within the toner hopper 9 to a toner replenishing unit 5*a* of the developing unit 5, and toner containers (toner bottles) 19 as a secondary particle accommodating unit that supplies toner to the toner hopper 9 in addition to the particle supply apparatus 20.

Further, the imaging apparatus main frame 1 includes a supply channel (recycling channel) 75 as a recycling route for conveying the untransferred toner collected by the cleaning unit 8 to the toner hopper 9. In certain embodiments, the supply channel 75 may use a conveyor screw or a pump such as a diaphragm air pump, for example.

In the following, normal imaging operations of the imaging apparatus according to the present embodiment are described with reference to FIG. 2.

First, a document is conveyed by a conveying roller of a document conveying unit from a document table to pass a document read unit. At this point, the document read unit optically reads image information of the passing document.

Then, the optical image information read by the document read unit is converted into an electrical signal to be transmitted to the exposure unit 16. In turn, the exposure unit 16 irradiates exposure light such as laser on the photoconductor drum 4 based on the electrical signal of the image information.

The photoconductor drum 4 rotates in the clockwise direction in FIG. 2. The surface of the photoconductor drum 4 is evenly charged by the charge unit 17 when it reaches the position opposing the charge unit 17. The surface of the photoconductor 4 charged by the charge unit 17 then reaches an exposure light irradiation position, and a latent image corresponding to the image information is formed at this irradiation position.

Then, the surface of the photoconductor drum 4 having the latent image formed thereon reaches a position opposing the developing unit 5 at which position the latent image on the photoconductor drum 4 is developed into a toner image by the developing unit 5.

In the developing unit 5, toner supplied from the toner replenishing unit 5*a* is mixed with a carrier by a paddle roller, for example. Then, the frictionally charged toner and the carrier are supplied to the surface of a developing roller opposing the photoconductor drum 4.

It is noted that toner in the developing unit 5 may be replenished by the toner replenishing unit 5*a* as is necessary in accordance with the consumption of toner within the developing unit 5. The consumption of toner within the developing unit 5 may be detected by a photo sensor arranged opposite the photoconductor 4 or a magnetic permeability sensor arranged within the developing unit 5, for example. The toner in the toner replenishing unit 5*a* may be replenished by supplying toner from the toner hopper 9 via the toner conveying channel 11 that uses a toner conveying coil or a particle pump, for example. The toner in the toner hopper 9 may be replenished by supplying toner from the particle supply apparatus 20 arranged outside the imaging apparatus main frame 1 using conveying mechanism 37, 40, 22, and 41.

According to the present embodiment, plural replaceable toner containers 19 are arranged at the toner hopper 9 so that toner may be supplied to the toner hopper 9 from the toner containers 19 as well as the particle supply apparatus 20. For example, the toner containers 19 may be used to supply toner to the toner hopper 9 when replacement operations for replacing a particle accommodating unit 31 of the particle supply unit 20 are being performed. In this way, downtime of the imaging apparatus may be avoided.

Also, according to the present embodiment, the toner containers 19 are bottle-shaped containers having spiral projecting portions formed at their inner surfaces. Thus, by rotating the toner container 19, toner within the toner container 19 may be discharged from the opening of the toner container 19 to be supplied to the toner hopper 9.

Then, the surface of the photoconductor drum 4 having the toner image developed by the developing unit 5 reaches a position opposing the transfer unit 6 at which position the transfer unit 6 transfers the toner image formed on the photoconductor drum 4 onto a recording medium such as paper. In this case, a small amount of untransferred toner remains on the surface of the photoconductor drum 4.

Then, the surface of the photoconductor drum 4 having the untransferred toner remaining thereon reaches a position opposing the cleaning unit 8 at which position the untransferred toner is removed by a cleaning blade of the cleaning unit 8 that comes into contact with the surface of the photoconductor drum 4 so that the remaining toner may be collected by the cleaning unit 8. The toner collected by the cleaning unit 8 is conveyed to the toner hopper 9 via the supply channel 75 as recycled toner and is supplied to the developing unit 5 (toner replenishing unit 5*a*) along with fresh toner supplied from the particle supply unit 20 and/or the toner containers 19. In this way, efficient recycle of toner may be realized in the imaging apparatus.

Then, the surface of the photoconductor drum 4 that has passed the cleaning unit 8 reaches a charge removal position (not shown) where the electric potential on the surface of the photoconductor drum 4 is removed so that the imaging operations may be ended.

In the following, operations for handling the recording medium conveyed to the transfer unit 6 are described.

First, one paper feed unit (e.g. paper feed unit 18) is manually or automatically selected from plural paper feed units.

Then, one piece of the recording medium (e.g. paper) accommodated in the selected paper feed unit 18 is moved in the direction of the dot-dashed line shown in FIG. 2 representing a paper conveying route.

Then, the recording medium fed from the paper feed unit 18 is conveyed to the position where a resist roller is arranged. The recording medium reaching the position of the resist roller is synchronized with the photoconductor drum 4 to adjust the positioning of the toner image and is conveyed to the transfer unit 6.

After transfer of the toner image onto the recording medium is completed, the recording medium moves past the transfer unit 6 to reach the position of the fixing unit 7. At this position, the toner image transferred onto the recording medium is fixed by the fixing unit 7 using heat and pressure. Then, after undergoing the fixing process, the recording medium is discharged from the imaging apparatus main frame 1 as an output image and delivered to the post process unit 3 that performs post processes on the discharged recording medium.

In the following, the configuration and operations of the particle supply apparatus 20 are described.

Figure 3:
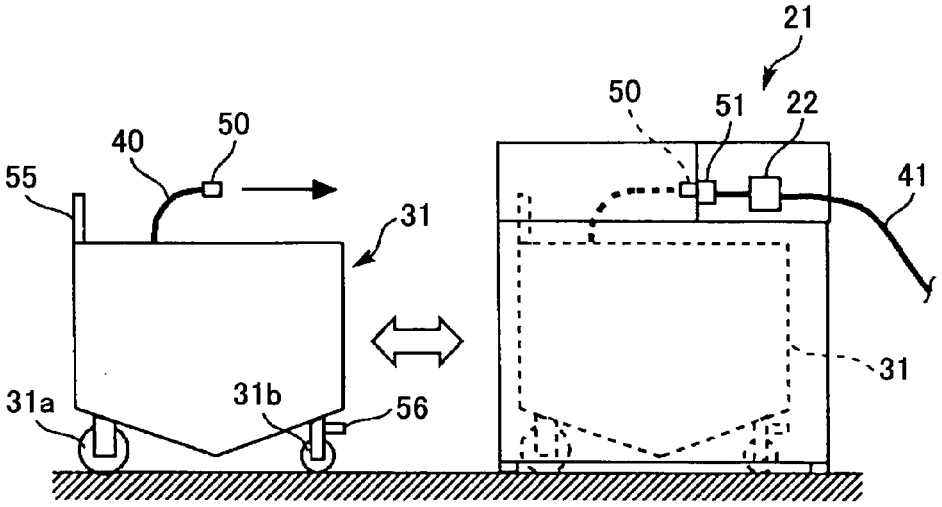
FIG. 3 is a diagram illustrating where a particle accommodating unit is detached from the particle supply apparatus according to the first embodiment.
Figure 4:
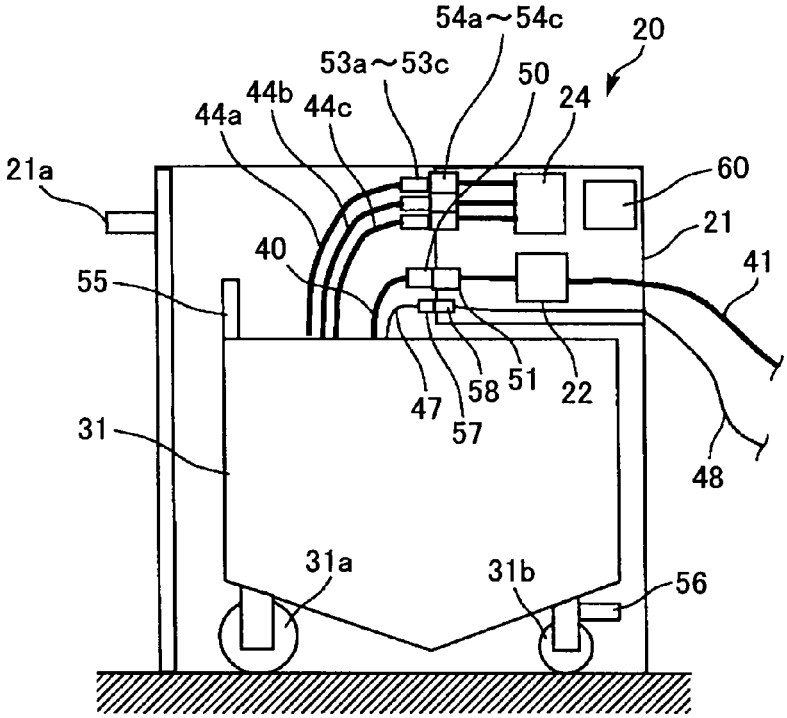
FIG. 4 is a diagram showing a detailed configuration of the particle supply apparatus according to the first embodiment.
Figure 5:
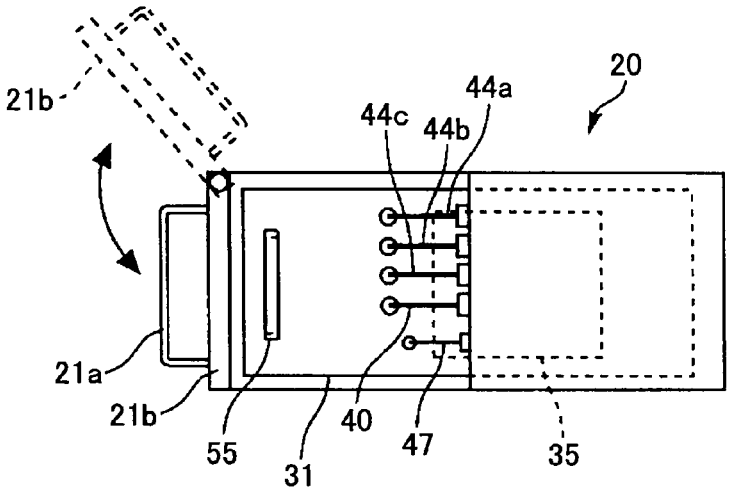
FIG. 5 is a top view of the particle supply apparatus according to the first embodiment.
Figure 6:
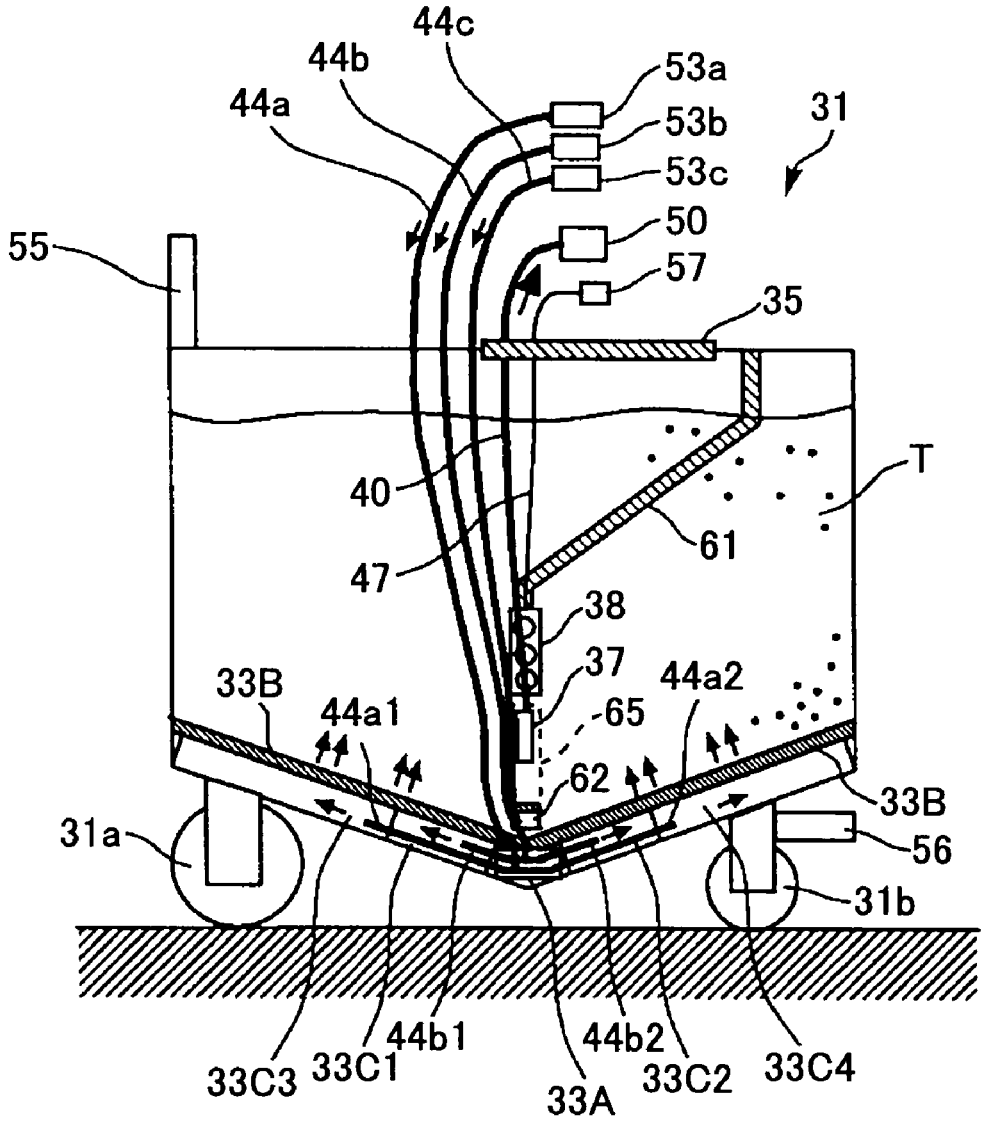
FIG. 6 is a diagram showing a configuration of the particle accommodating unit of the particle supply apparatus according to the first embodiment.

FIG. 3 is a diagram illustrating the particle accommodating unit being detached from the particle supply apparatus. FIG. 4 is a diagram showing a configuration of the particle supply apparatus. FIG. 5 is a top view of the particle supply apparatus. FIG. 6 is a diagram showing a configuration of the particle accommodating unit of the particle supply apparatus.

As is shown in FIGS. 2-5, the particle supply apparatus (toner supply unit) 20 includes a particle supply apparatus main frame (fixed unit) 21 that is fixed to the imaging apparatus (paper feed bank 2) and the particle accommodating unit (toner tank unit) 31 that accommodates toner (particles).

As is shown in FIG. 3, the particle accommodating unit 31 is configured to be detachable from the particle supply apparatus main frame 21. Specifically, the particle accommodating unit 31 has two pairs of casters 31*a* and 31*b* arranged at the four corners of its bottom side for supporting the particle accommodating unit 31 in an upright position and enabling the particle accommodating unit 31 to move with respect to a resting face on which it rests. Also, the particle accommodating unit 31 has a second gripper 55 arranged at its upper side. With such an arrangement, an operator such as a user or a serviceperson may grip the second gripper 55 and move the particle accommodating unit 31 in/out of the particle supply main frame 21 in the directions indicated by the arrow shown in FIG. 3 using the casters 31*a*.

Further, in the present embodiment, the particle accommodating unit 31 has a first gripper 56 arranged at its bottom side as is described in detail below with reference to FIG. 10.

The particle supply apparatus main frame 21 includes a door 21*b* having a handle 21*a* (see FIG. 5). The door 21*b* may be opened/closed to install/detach the particle accommodating unit 31 into/from the particle supply apparatus main frame 21. In this case, connection members 50, 53*a*-53*c*, and 57 of the particle accommodating unit 31 are connected/detached to/from connection members 51, 54*a*-54*c*, and 58 of the particle supply apparatus main frame 21 (see FIG. 4).

According to the present embodiment, the casters 31*a* and 31*b* are arranged close to the uppermost edge portions of a V-shaped sloping bottom surface of the particle accommodating unit 31 so that the height of the particle accommodating unit 31 including the casters 31*a* and 31*b* may be relatively low. Also, as is described in detail below with reference to FIG. 10, one of the pairs of casters 31*a* is arranged to have a greater wheel diameter compared to the other pair of casters 31*b*.

It is noted that the number of casters and their positions are not limited to the above-illustrated embodiment, and any number of casters may be attached to the particle accommodating unit 31 at suitable positions for enabling the particle accommodating unit 31 to move with respect to the ground surface without toppling over, for example. Also, the shape and position of the second gripper 55 is not limited to the above-illustrated embodiment, and the second gripper 55 may be arranged into other suitable shapes and at other suitable positions for enabling the particle accommodating unit 31 to be easily moved with respect to the ground surface.

In the particle supply apparatus 20 according to the present embodiment, the particle accommodating unit 31 may be moved and detached from the particle supply apparatus main frame 21 so that when the particle accommodating unit 31 becomes nearly empty, it may be replaced by another particle accommodating unit 31 that has ample toner accommodated therein. In this way, toner may be continually supplied to the imaging apparatus main frame 1. Also, it is noted that the particle supply apparatus 20 has a separate power supply unit 60 that is different from the power supply unit for the imaging apparatus main frame 1 so that operations for replacing the particle accommodating unit 31 may be performed without having to turn off the power of the imaging apparatus main frame 1. In other words, the replacement operations may be performed without causing downtime of the imaging apparatus main frame 21.

As is shown in FIG. 4, the particle supply apparatus main frame 21 includes a pump (conveying mechanism) 22 that introduces the toner T accommodated in the particle accommodating unit 31 by suction force and discharges the toner toward a supply destination (toner hopper 9), an air pump 24 that supplies air to a gas spouting unit (fluidized bed) 33 (see FIG. 6) of the particle accommodating unit 31, and the power supply unit 60, for example. In one preferred embodiment, a diaphragm air pump may be used as the pump 22.

It is noted that in the present embodiment, the toner hopper 9 of the imaging apparatus main frame 1 corresponds to the supply destination for the toner supplied from the particle supply apparatus 20; however, in an alternative embodiment, the toner replenishing unit 5*a* of the developing unit 5 may be the supply destination for the toner supplied from the particle supply apparatus 20, for example.

As is shown in FIG. 6, the particle accommodating unit 31 includes a suction pipe 37; the gas spouting unit 33; four tubes 40 and 44*a*-44*c* made of flexible silicon rubber; a second gas spouting unit 62, a holding member 65 that holds the second gas spouting unit 62 and the suction pipe 37, a remaining toner sensor (near end sensor) 38 as detection means for detecting the amount of toner remaining in the particle accommodating unit 31; a cable (harness line) 47 electrically connected to the remaining toner sensor 38; and a support member 61 that supports the remaining toner sensor 38, the holding member 65, and the cable 47, for example. Also, the particle accommodating unit 31 accommodates toner T having a volume average particle diameter within a range of 3-15 μm. The horizontal cross section of the particle accommodating unit 31 is arranged into a rectangular shape to secure adequate capacity for accommodating the toner T.

The bottom surface of the particle accommodating unit 31 is arranged into a sloped surface with a center portion arranged at a lowermost position. In other words, the bottom surface of the particle accommodating unit 31 is arranged into a V-shaped sloping surface. The gas spouting unit (fluidized bed) 33 is arranged along the sloping bottom surface of the particle accommodating unit 31.

It is noted that the sloping angle of the sloping bottom surface of the particle accommodating unit 31 is arranged to be smaller than the angle of repose for the toner T accommodated within the particle accommodating unit 31. Specifically, for example, while the angle of repose for the toner T may be approximately 40 degrees, the sloping angle of the sloping surface may be approximately 20 degrees. By arranging the sloping angle of the sloping surface to be relatively small, a dead space created as a result of sloping may be reduced and the toner may be prevented from piling up at a lowermost region (region around the lowermost position) of the sloping surface to excessively increase the bulk density at this region.

The gas spouting unit 33 includes an intermediate unit 33A, a porous member 33B, and four chambers 33C1-33C4, for example, and is configured to spout air (gas) into the particle accommodating unit 31. The lateral cross section (i.e., cross section orthogonal to the air spouting direction) of the gas spouting unit 33 is arranged into a substantially rectangular shape.

The porous member 33B of the gas spouting unit 33 has holes with diameters that are arranged to be smaller than the particle size (diameter) of toner T, and is arranged at a side that comes into direct contact with the toner T accommodated within the particle accommodating unit 31. Air discharged from the air pump 24 of the particle supply apparatus main frame 21 is supplied to the porous member 33B via the tubes 44*a*, 44*b*, and the chambers 33C1-33C4, and the porous member 33B acts as the air spouting outlet for spouting air into the particle accommodating unit 31.

It is noted that the porous member 33B is made of a porous material having fine holes for passing air. The porous member 33B is configured to have an aperture ratio of 5-40% (preferably within 10-20%) and an average aperture diameter of 0.3-20 μm (preferably within 5-15 μm), and the average hole diameter of its holes is arranged to be 0.1-5 times (preferably 0.5-3 times) the volume average particle diameter of the toner T.

The porous member 33B may be made of glass, sintered resin particles, photo-etched resin, thermally perforated resin or some other type of porous resin material, sintered metal, a perforated metal plate material, a mesh laminate, or a metal material having selectively fused holes that may be obtained by causing precipitation of metal copper around fusible metal threads through electrochemical processing to fabricate a copper plate with the fusible metal threads implanted therein and selectively removing the fusible metal threads implanted into the copper plate, for example.

By spouting air toward the toner T accommodated in the particle accommodating unit 31 via the porous member 33B as is described above, the bulk density of the toner may be reduced, the toner T may be fluidized, and cross-linking of the toner T may be prevented, for example. It is noted that since each toner particle weighs relatively little and a relatively strong air pressure is applied to the porous member 33B, it is unlikely for a toner particle to penetrate the chambers 33C1-33C4 or clog up the porous member 33B even when the toner particle enters a hole of the porous member 33B.

As is shown in FIG. 6, four independent chambers 33C1-33C4 are arranged below the porous member 33B.

Specifically, the first chamber 33C1 and the second chamber 33C2 are adjacent to the intermediate unit 33A that is arranged at the lowermost region of the sloping bottom surface. The first chamber 33C1 receives air from the air pump 24 that is conveyed through the connection members 53*b*, 54*b*, and the tube (second tube) 44*b* and diverged by the intermediate unit 33A via a discharge outlet 44*b*1. The second chamber 33C2 receives air from the air pump 24 that is conveyed through the connection members 53*b*, 54*b* and the second tube 44*b* and diverged by the intermediate unit 33A via a discharge outlet 44*b*2. The air supplied to the first chamber 33C1 and the second chamber 33C2 is spouted at the lowermost region of the sloping surface of the particle accommodating unit 31 via the porous member 33B.

The third chamber 33C3 and the fourth chamber 33C4 are adjacent to the first chamber 33C1 and the second chamber 33C2, respectively. The third chamber 33C3 receives air from the air pump 24 that is conveyed via the connection members 53*a*, 54*a*, and the tube (first tube) 44*a* and diverged by the intermediate unit 33A via a discharge outlet 44*a*1. The fourth chamber 33C4 receives air from the air pump 24 that is conveyed via the connection members 53*a*, 54*a*, and the first tube 44*a* and diverged by the intermediate unit 33A via a discharge outlet 44*a*2. The air supplied to the third chamber 33C3 and the fourth chamber 33C4 is spouted at regions of the sloping bottom surface other than the lowermost region via the porous member 33B.

As is described above, the connection members 53*a* and 53*b* are arranged at the particle accommodating unit 31, and the connection members 54*a* and 54*b* are arranged at the particle supply apparatus main frame 21. When the particle accommodating unit 31 is installed in the particle supply apparatus main frame 21, the connection members 53*a*, 53*b*, 54*a*, and 54*b* are interconnected to act as intermediate connectors of a gas conveying path extending from the air pump 24 to the gas spouting unit 33. When the particle accommodating unit 31 is detached from the particle supply apparatus main frame 21, the connection members 53*a*, 53*b*, 54*a*, and 54*b* are detached to disconnect the gas conveying path. In this way, the particle accommodating unit 31 may be easily attached to and detached from the particle supply apparatus main frame 21.

It is noted that the area (i.e. area of contact surface that is in contact with the porous member 33B) or the volume of the first chamber 33C1 and the second chamber 33C2 is arranged to be smaller than the area or volume of the third chamber 33C3 and the fourth chamber 33C4.

By arranging the gas spouting unit 33 to have the above-described configuration, the gas spouting amount per unit area per unit time at the lowermost region of the sloping surface (where the first chamber 33C1 and the second chamber 33C2 are arranged) may be greater than the gas spouting amount per unit area per unit time at other regions of the sloping surface (where the third chamber 33C3 and the fourth chamber 33C4 are arranged). It is noted that the toner at the lowermost region of the sloping surface tends to have a higher bulk density compared to the rest of the regions of the sloping surface. Thus, by varying the gas spouting amount of the gas spouting unit 33 for the different positions on the sloping surface, uniform fluidity of the toner may be achieved throughout the sloping surface in an efficient manner, for example.

As can be appreciated from the above descriptions, according to the present embodiment, plural chambers (e.g., first through fourth chambers 33C1-33C4) are provided at the gas spouting unit 33, and air from the air pump 24 is individually supplied to the different chambers so that the gas spouting amount may be varied for the different positions on the sloping surface. In the present embodiment, the difference in the gas spouting amount is created by varying the size of the chambers (area or volume of the chambers 33C1-33C4) from which air is spouted.

However, it is noted that measures for varying the gas spouting amount is not limited to the above-described embodiment, and other measures may be implemented such as arranging different porous members (e.g., having different hole diameters and/or hole densities) at different positions of the sloping surface, or varying the air pressure of air discharged from the air pump 24.

In a preferred embodiment, the gas spouting amount per unit area per unit time at the lowermost region of the sloping surface (where the first chamber 33C1 and the second chamber 33C2 are arranged) is adjusted to be 1.1-2 times greater than the spouting amount per unit area per unit time at the other regions of the sloping surface (where the third chamber 33C3 and the fourth chamber 33C4 are arranged) in order to achieve advantageous effects as described above such as reduced toner bulk density and uniform toner fluidity, for example.

It is noted that the suction pipe 37 is arranged above the intermediate unit 33A (the lowermost position of the sloping surface) so that the toner T may be efficiently introduced into the suction pipe 37 even when the amount of toner T remaining in the particle accommodating unit 31 becomes small. The suction pipe 37 is connected to one end of the pump 22 via the suction tube 40, and the connection members (intermediate pipes) 50 and 51. The other end of the pump 22 is connected to the toner hopper 9 of the imaging apparatus main frame 1 via a discharge tube (conveying mechanism) 41. According to the present embodiment, the suction pipe 37, the suction tube 40, and the connection members 50 and 51 form a particle suction path from the particle accommodating unit 31 to the pump 22, and the discharge tube 41 forms a particle discharge path from the pump 22 to the toner hopper 9. When the pump 22 is activated, the toner T within the particle accommodating unit 31 is introduced into the suction pipe 37 via a suction port 37*a* and is conveyed to the toner hopper (supply destination) via the pump 22.

As is described above, the connection member 50 is arranged at the particle accommodating unit 31, and the connection member 51 is arranged at the particle supply apparatus main frame 21. When the particle accommodating unit 31 is installed in the particle supply apparatus main frame 21, the connection members 50 and 51 are interconnected to act as intermediate connectors of the particle suction path (i.e., path extending from the suction port 37*a* to the pump 22). When the particle accommodating unit 31 is detached from the particle supply apparatus main frame 21, the connection members 50 and 51 are detached to disconnect the particle suction path. In this way, the particle accommodating unit 31 may be easily attached to and detached from the particle supply apparatus main frame 21.

In a preferred embodiment, the suction tube 40 and the discharge tube 41 are made of silicon rubber that has low toner affinity so that the toner T may be prevented from bonding with the tube to degrade toner transferability, for example.

In another preferred embodiment, at least a part of the particle suction path and the particle discharge path is made of a flexible tube (e.g. tubes 40 and 41) in order to allow flexibility in the layout of the particle accommodating unit 31, the pump 22, and the toner hopper 9.

As is shown in FIG. 2, the pump 22 is positioned above the toner hopper 9 corresponding to the toner supply destination. Accordingly, the toner T that is introduced into the pump 22 is discharged to the toner hopper 9 that is positioned lower than the pump 22. With such an arrangement, toner may be accurately conveyed with a relatively small discharge force owing to the positional level difference between the pump 22 and the toner hopper 9 even when the distance from the pump 22 to the toner hopper 9 is relatively long, for example.

In a preferred embodiment, the slope angle θ of the particle discharge path formed by the discharge tube 41 may be within 20-90 degrees (more preferably within 25-45 degrees). In this way, toner may be efficiently conveyed through the particle discharge path by the discharge force of the pump 22 as well as the gravitational falling force created by the slope angle.

Also, according to the present embodiment, the suction port 37*a* (suction pipe 37) of the particle suction path is positioned lower than the pump 22. Specifically, the toner T within the particle accommodating unit 31 is introduced into the suction pipe 37 (e.g., having an internal diameter of approximately 6-8 mm) positioned at the lowermost region of the particle accommodating unit 31 and conveyed upward by suction force. In a preferred embodiment, the distance between the pump 22 and the suction pipe 37 is arranged to be shorter than the distance between the pump 22 and the toner hopper 9 in order to reduce the suction force of the pump 22 required for conveying the toner T upward against the gravitational force so that the toner T within the particle accommodating unit 31 may be efficiently conveyed by suction force. Also, since the toner T is directed upward in the particle suction path, the toner T may be prevented from scattering in large amounts when the suction tube 40 is damaged or detached; that is, the scattered toner may be limited to that flowing within the suction tube 40, for example.

According to the present embodiment, the vertical distance H1 between the suction port 37*a* of the suction pipe 37 and the pump 22 is arranged to be 1.5-2 times the vertical distance H2 between the toner hopper 9 and the pump 22 (see FIG. 2). In this way, overall balance may be maintained in the conveying path for conveying toner from the suction port 37*a* of the suction pipe 37 to the toner hopper 9 via the pump 22.

Also, according to the present embodiment, the pump 22 (particle supply apparatus main frame 21) and the particle accommodating unit 31 are arranged outside the imaging apparatus main frame 1 so that the configuration of the particle supply apparatus 20 may not be restricted by the configuration of the imaging apparatus main frame 1. For example, the pump 22 may be arranged at a desired position regardless of the height of the imaging apparatus main frame 1. In another example, the imaging apparatus main frame 1 may be stationed within an office space whereas the particle supply apparatus 20, which is prone to cause tainting by toner, may be stationed outside the office space.

Figure 7:
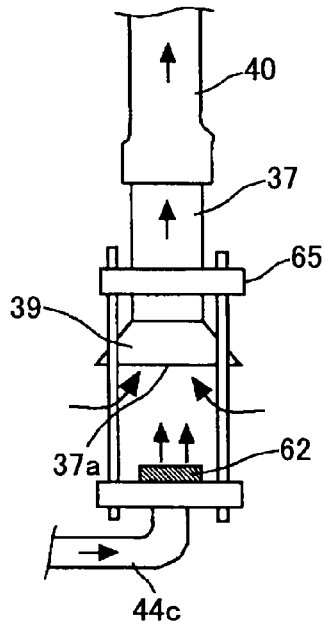
FIG. 7 is an enlarged partial view of an area surrounding a suction tube.

FIG. 7 is a diagram illustrating in detail the suction pipe 37 and elements associated therewith. As is shown in this drawing, the suction pipe 37 is fixed to the holding member 65 that is supported by the support 61 (see FIG. 6). The second gas spouting unit 62 held by the holding member 65 is arranged below the suction pipe 37. The holding member 65 (and support 61) is configured to fix the position of the suction pipe 37 within the particle accommodating unit 31 and the position of the second gas spouting unit 62 with respect to the suction pipe 37.

The second gas spouting unit 62 spouts air from the air pump 24 that is conveyed via the connection members 53*c*, 54*c*, and the tube (third tube) 44*c* directly toward the suction port 37*a* of the suction pipe 37 (and the remaining toner sensor 38 shown in FIG. 6), and is made of a porous material. In one embodiment, the second gas spouting unit 62 may include one or more chambers. The porous material of the second gas spouting unit 62 is identical to the material used for the porous material 33B of the gas spouting unit 33. In this way, the bulk density of the toner T around the suction port 37*a* of the suction pipe 37 may be reduced and the toner may be fluidized so that clogging of the conveying mechanism 22, 37, 40, and 41 may be prevented and toner transferability may be improved, for example. Also, the toner T around the remaining toner sensor 38 may be fluidized so that detection performance of the remaining toner sensor 38 may be stabilized, for example.

It is noted that in the present embodiment, the second gas spouting unit 62 is used to spout air toward the suction port 37*a* of the suction pipe 37 and the remaining toner sensor 38; however, the present invention is not limited to such an embodiment and for example, a gas spouting unit for spouting air toward the region close to the suction port 37*a* of the suction pipe 37 and a gas spouting unit for spouting air toward the region close to the remaining toner sensor 38 may be separately provided. In another alternative embodiment, the second gas spouting unit 62 and the gas spouting unit 33 arranged at the bottom of the particle accommodating unit 31 may be combined to form one gas spouting unit, for example.

Also, as is shown in FIG. 7, in the present embodiment, a rectifying member 39 is provided at the suction port 37*a* of the suction pipe 37. The rectifying member 39 is a funnel-shaped member that enlarges the opening area of the suction port 37*a* to increase the suction force of the suction port 37*a*.

Figure 8:
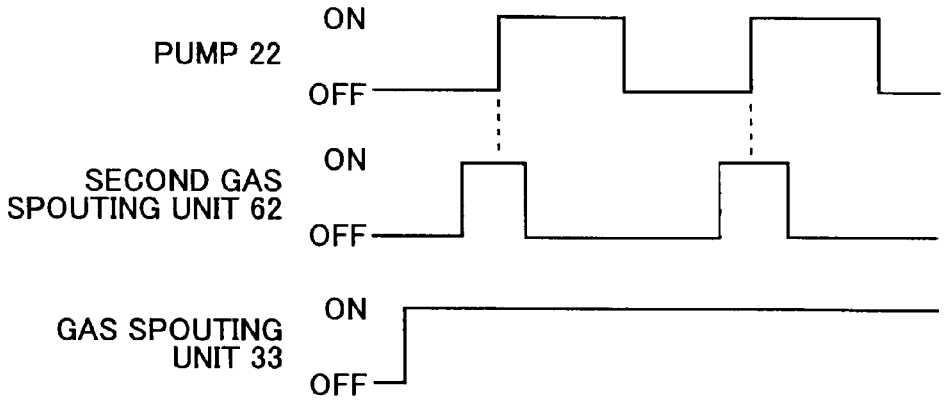
FIG. 8 is a timing chart illustrating control operations for controlling a second gas spouting unit.

FIG. 8 is a timing chart illustrating operations of the particle supply apparatus 20 according to the present embodiment. As is shown in this drawing, before suction operations of the pump 22 (fluid suction via the suction pipe 37) are started, operations of the second gas spouting unit 62 for spouting air toward the suction port 37*a* are started. In this way, fluidization of toner may be ensured at the time toner is introduced into the suction pipe 37 so that toner transfer may be smoothly performed by the conveying mechanism 22, 37, 40, and 41.

Also, the operations of the second gas spouting unit 62 for spouting air toward the suction port 37*a* are ended before the suction operations by the pump 22 (fluid suction via the suction pipe 37) are ended. Specifically, once the fluidity of toner is induced by the second gas spouting unit 62 right before toner suction operations via the suction pipe 37 are started, the toner transfer operations may be smoothly performed by the conveying mechanism 22, 37, 40, and 41 without continuing the operations of the second gas spouting unit 62. Accordingly, in the present embodiment, the operations of the second gas spouting unit 62 are terminated after a predetermined time elapses from the time operations of the pump 22 are started in order to reduce the duty time of the second gas spouting unit 62.

It is noted that in the present embodiment, the operations of the gas spouting unit 33 (33A, 33B, 33C1-33C4) are performed independent of the operations of the second gas spouting unit 62. The operations of the gas spouting unit 33 may be continually performed, intermittently performed, or performed according to the decrease in fluidity of the toner within the particle accommodating unit 31 (e.g., at predetermined time intervals), for example. In one embodiment, the timing for supplying air to the first chamber 33C1 and the second chamber 33C2 and the timing for supplying air to the third chamber 33C3 and the fourth chamber 33C4 may be varied in order to obtain uniform fluidity of the toner within the particle accommodating unit 31 in an efficient manner, for example.

In another embodiment, operations of the second gas spouting unit 62 may be intermittently performed while the pump 22 is in operation so that toner transferability may be improved when the pump 22 is continually operated for a long period of time, for example.

In another embodiment, operations of the second gas spouting unit 62 may be intermittently performed in a case where the pump 22 is not operated (abandoned) for a long period of time so that toner transfer operations may be smoothly performed in response to activation of the pump 22 even after the pump has been abandoned for a long period of time, for example.

In another embodiment, the second gas spouting unit 62 may be forcefully operated for a predetermined period of time when the main switch of the imaging apparatus main frame 1 is turned on. In this way, warm up operations may be performed in the particle supply apparatus 20 when warm up operations are performed in the imaging apparatus main frame 1 and smooth toner transfer operations may be immediately performed in response to activation of the second gas spouting unit 62, for example.

It is noted that in the present embodiment, three tubes 44*a*-44*c* are used to separately supply air to the third chamber 33C3 and fourth chamber 33C4, the first chamber 33C1 and second chamber 33C2, and the second gas spouting unit 62, respectively. In this way, air flow and air pressure may be easily adjusted according to the characteristics of the different air supply destinations, for example.

Referring to FIGS. 5 and 6, the particle accommodating unit 31 has an opening and a filter (evacuation member) 35 that covers that opening at its upper face. The filter 35 prevents the toner T within the particle accommodating unit 31 from leaking outside and prevents the internal pressure of the particle accommodating unit 31 from increasing. The filter 35 may be made of a material that is identical to that used for the porous member 33B, or some other material such as GORE-TEX (registered trademark of Japan Gore-Tex, Inc.) corresponding to a porous fluorine resin material. It is noted that the filter 35 may be positioned at any position above the toner load line of the particle accommodating unit 31 formed when the toner is full. For example, the filter 35 does not necessarily have to be provided at the upper face of the particle accommodating unit 31 and may alternatively be arranged at a side face of the particle accommodating unit 31.

Figure 9:
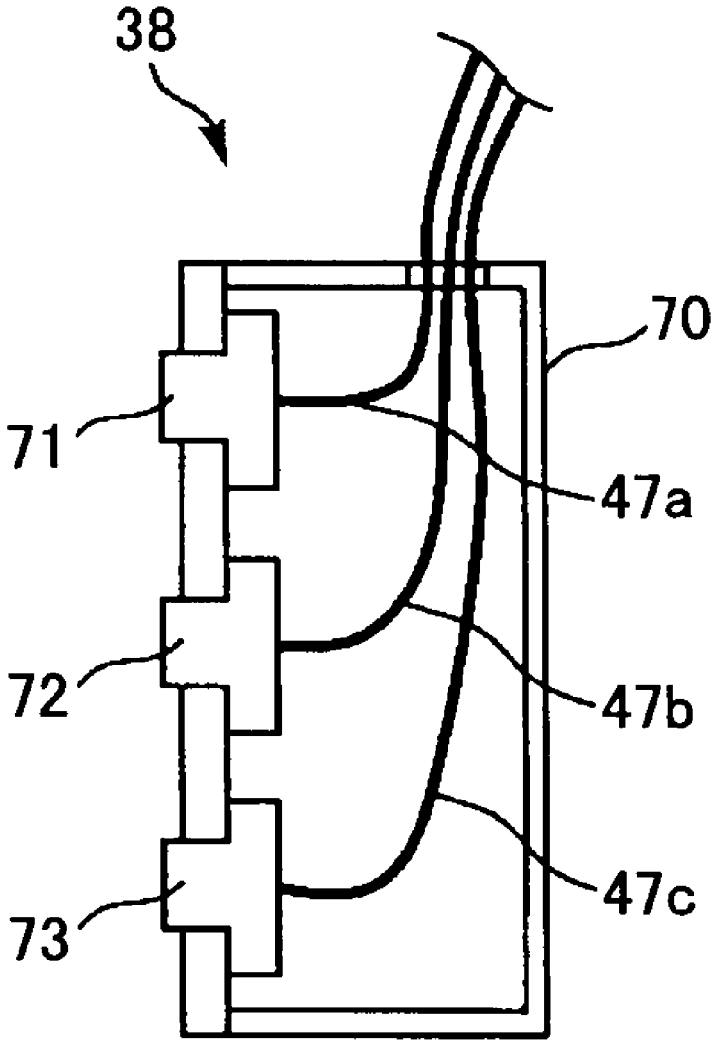
FIG. 9 is a cross-sectional view of a remaining toner sensor.

FIG. 9 is a diagram showing a detailed configuration of the remaining toner sensor 38. As is shown in this drawing, the remaining toner sensor 38 includes three piezoelectric sensors 71-73 that are aligned in a vertical direction. The three piezoelectric sensors 71-73 are held by a case 70 that is supported by the support 61. The three piezoelectric sensors 71-73 are electrically connected to cables 47*a*-47*c*, respectively, and the cables 47*a*-47*c* are bound together within the case 70 to form a bundled cable 47 that is supported by the support 61 and electrically connected to a control unit of the imaging apparatus main frame 1 via the connection members 57, 58, and a cable 48 (see FIG. 4).

As is described above, the connection member 57 is arranged at the particle accommodating unit 31, and the connection member 58 is arranged at the particle supply apparatus main frame 21. When the particle accommodating unit 31 is attached to the particle supply apparatus main frame 21, the connection members 57 and 58 act as intermediate connectors connecting the cable 47 extending from the remaining toner sensor 38 to the particle supply apparatus main frame 21. When the particle accommodating unit 31 is detached from the particle supply apparatus main frame 21, the connection members 57 and 58 are detached to disconnect the cable 47. In this way, the particle supply apparatus main frame 21 may be easily attached to and detached from the particle accommodating unit 31.

In the present embodiment, the remaining toner sensor 38 is configured to inform a user of the remaining amount of toner within the particle accommodating unit 31 by measuring the remaining amount of toner on a scale of three different levels.

Specifically, when the uppermost piezoelectric sensor 71 of the remaining toner sensor 38 detects that there is no toner at its corresponding position (height), a message indicating that the remaining amount of toner within the particle accommodating unit 31 is decreasing may be displayed at a display unit of the imaging apparatus main frame 1 ("PRE NEAR END" display). Then, when the middle piezoelectric sensor 72 of the remaining toner sensor 38 detects that there is no toner at its corresponding position (height), a message indicating that the toner within the particle accommodating unit 31 is almost gone may be displayed at the display unit of the imaging apparatus main frame 1 ("NEAR END" display). Then, when the lowermost piezoelectric sensor 73 of the remaining toner sensor 38 detects that there is no toner at its corresponding position (height), a message indicating that there is not toner remaining in the particle accommodating unit 31 may be displayed at the display unit of the imaging apparatus main frame 1 ("TONER END" display) and suction operations of the pump 22 may be stopped until replacement operations for replacing the particle accommodating unit 31 are completed, for example.

It is noted that the remaining toner sensor 38 is provided outside the suction pipe 37 in the present embodiment so that toner clumps may be prevented from being generated within the suction pipe 37.

Also, the remaining toner sensor 38 is positioned above the suction port 37*a* of the suction pipe 37 in the present embodiment so that cases in which only air is introduced into the suction pipe 37 may be prevented. Specifically, the remaining toner sensor 38 may be used to send a signal to stop toner suction operations by the pump 22 while the toner is still at a position (level) above the suction port 37*a*. In this way, the suction pipe 37 may be prevented from merely introducing air by suction when the toner is already gone (or when the mixing rate of toner with respect to air is low).

Also, the remaining toner sensor 38 is positioned above the gas spouting unit 33 in the present embodiment so that the remaining toner detection accuracy of the remaining toner sensor 38 may be improved, for example. Specifically, by arranging the gas spouting unit 33 to fluidize the toner, the toner remaining amount may be stably and accurately detected, for example.

Also, the remaining toner sensor 38 is positioned above the lowermost position of the sloping surface of the gas spouting unit 33 in the present embodiment so that the remaining toner sensor may accurately detect the remaining amount of toner within the particle accommodating unit 31 being introduced into the suction tube 37 that is also positioned above the lowermost position to enable efficient and economical transfer of the toner.

Also, the remaining toner sensor 38 may be accurately positioned within the particle accommodating unit 31 by the support 61 and the case 70 in the present embodiment.

Also, the second gas spouting unit 62 is arranged at the lower side of the remaining toner sensor 38 in the present embodiment so that toner may be fluidized in the vicinity of the remaining toner sensor 38 and detection accuracy of the remaining toner sensor 38 may be stabilized.

In the following, the configuration and transportation method of the particle accommodating unit 31 used in the present embodiment are described.

Figure 10A:
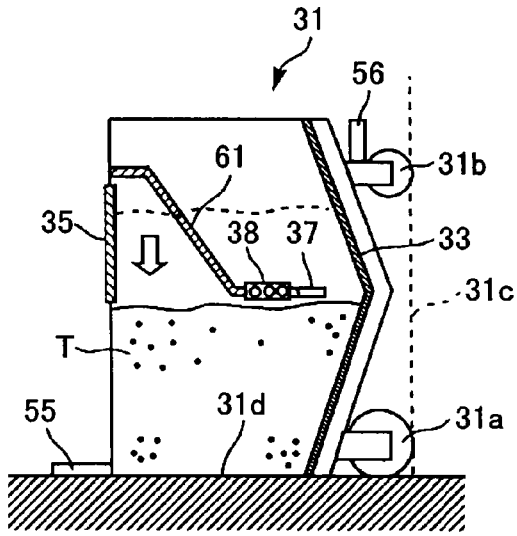
FIGS. 10A-10C are diagrams showing the disposition of the particle accommodating unit upon its transportation and the disposition of the particle accommodating unit during operation.
Figure 10B:
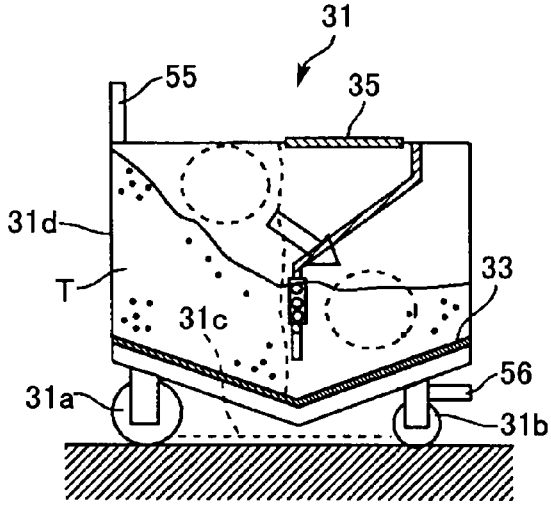

FIG. 10A is a diagram showing a disposition of the particle accommodating unit 31 when it is being transported. FIG. 10B is a diagram showing the interior state of the particle accommodating unit 31 right after the disposition of the particle accommodating unit 31 is changed from that during its transportation to that when it is operated.

As is described above, the particle accommodating unit 31 is arranged to be detachable with respect to the particle supply apparatus main frame 21. When the particle accommodating unit 31 installed in the particle supply apparatus main frame 21 reaches a toner end status, this particle accommodating unit 31 is removed from the particle supply apparatus 21, and another particle accommodating unit 31 accommodating ample toner that is transported from a service station may be installed in the particle supply apparatus main frame 21 as a replacement.

It is noted that the particle accommodating unit 31 may be transported via various transportation means including land transportation using trucks or trains, air transportation, and water transportation, for example.

In the present embodiment, as is shown in FIG. 10A, the particle accommodating unit 31 being detached from the particle supply apparatus 21 is arranged to rest on one of its side other than the bottom side upon being transported. Specifically, in FIG. 10A, the particle accommodating unit 31 is arranged to rest on its side face 31*d* that intersects the bottom portion including the gas spouting unit 33. In other words, upon being transported (i.e., when low frequency oscillation is applied to the particle accommodating unit 31 as is described in detail below), the particle accommodating unit 31 is arranged to stand on its side face.

Figure 10C:
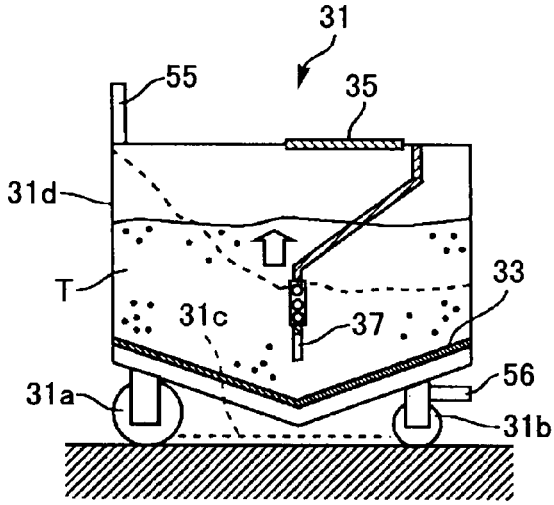

On the other hand, as is shown in FIGS. 10B and 10C, the particle accommodating unit 31 is arranged to rest on its bottom face during operations (i.e., when it is installed in the particle supply apparatus main frame 21). In other words, after being transported by a truck or some other transportation means, the disposition of the particle accommodating unit 31 is changed to an upright position. Specifically, the first gripper 56 may be gripped to turn the particle accommodating unit 31 around one of the pairs of casters 31*a* as the pivot so that the particle accommodating unit 31 may stand in an upright position.

In this way, even when toner blocking occurs within the particle accommodating unit 31 during its transportation, defective toner supply operations may be prevented from occurring in the particle supply apparatus according to the present embodiment.

It is noted that the inventor of the present invention has discovered through extensive research and investigation that when the particle accommodating unit 31 is disposed in an upright position (in the position shown in FIG. 6) upon being transported, the toner load line of toner T accommodated in the particle accommodating unit 31 gradually sinks to a lower level in accordance with the elapse of transportation time to eventually result in toner blocking. Such an effect is caused by low frequency oscillation being applied to the particle accommodating unit 31 during its transportation which in turn causes reduction of air between toner particles and an increase in the toner bulk density. When toner blocking occurs in the above-described manner, the toner accommodated within the particle accommodating unit 31 may not be easily fluidized even when gas is spouted from the gas spouting unit 33 upon operation of the particle accommodating unit 31. As a result, toner suction operations by the suction tube 37 may be degraded, and in turn, toner supply operations with respect to the imaging apparatus main frame 1 may be degraded.

In the case of arranging the particle accommodating unit 31 to rest on its side face (in the position shown in FIG. 10A) during its transportation, the toner load line of toner T accommodated in the particle accommodating unit 31 gradually sinks to a lower level (in the direction indicated by the arrow shown in FIG. 10A) in accordance with the elapse of transportation time in a similar manner as is described above to eventually result in toner blocking (high toner bulk density). However, by changing the disposition of the particle accommodating unit 31 to an upright position as is shown in FIG. 10B from the position of FIG. 10A, a portion of the blocked toner T (upper portion) breaks and falls towards the bottom (moves in the direction indicated by the arrow shown in FIG. 10B) by the force of gravity. Accordingly, when gas is spouted from the gas spouting unit 33, fluidization of the portion of the toner T that has fallen may function as a trigger for inducing fluidization of the blocked toner T to result in an increase in the bulk density of the toner T accommodated in the particle accommodating unit 31 (i.e., the toner load line rises to a higher level as is indicated by the arrow shown in FIG. 10C). In this way, proper toner supply operations for supplying toner from the particle supply apparatus 20 to the imaging apparatus main frame 1 may be enabled upon operation.

Figure 11:
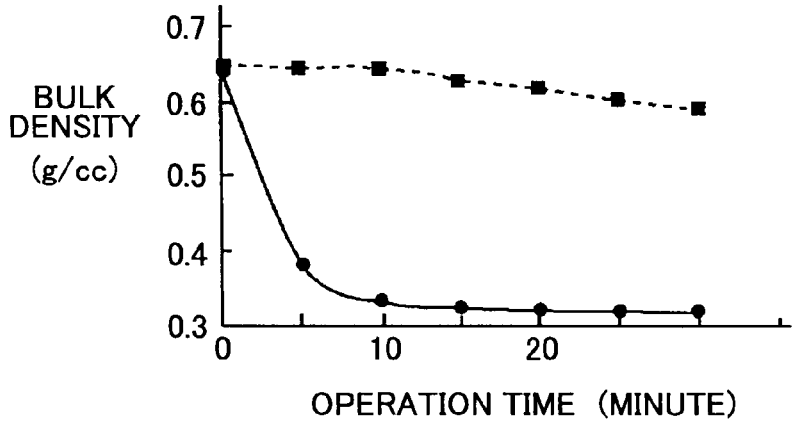
FIG. 11 is a graph showing testing results indicating the advantageous effects of the present embodiment.

FIG. 11 is a graph showing testing results for assessing the effects of the present embodiment.

In the graph shown in FIG. 11, the horizontal axis represents the time during which gas is spouted from the gas spouting unit 33 at 15 liters per minute (operation time) after low frequency oscillation is applied to the particle accommodating unit 31 for a predetermined time period, and the vertical axis represents the bulk density of the toner accommodated in the particle accommodating unit 31. Also, it is noted that the dashed line shown in the graph of FIG. 11 represents testing results of a case in which oscillation is applied to the particle accommodating unit 31 that is disposed in an upright position (position shown in FIG. 6), and the solid line represents testing results of a case in which oscillation is applied to the particle accommodating unit 31 that is resting on its side face (present embodiment).

As can be appreciated from FIG. 11, when the particle accommodating unit 31 is disposed in an upright position upon being transported (i.e., upon receiving the lower frequency oscillation), the toner bulk density hardly changes even after the gas spouting unit 33 is activated. On the other hand, when the particle accommodating unit 31 is arranged to rest on its side face upon being transported (i.e., upon receiving the low frequency oscillation), the toner bulk density in the particle accommodating unit 31 may gradually decrease after activating the gas spouting unit 33 by changing the disposition of the particle accommodating unit 31 to the upright position after its transportation.

It is noted that the advantageous effects of the present embodiment have also been confirmed by the testing results obtained by a logarithmic sweep oscillation test conforming to JIS Z0232 that has been separately conducted by the inventor of the present invention.

In the following descriptions, it is assumed that the particle accommodating unit 31 has a width of 650 mm, a depth of 240 mm, and a height of 700 mm. It is noted that advantageous effects of the present embodiment may become particularly prominent when the particle accommodating unit 31 is relatively large (i.e., when the toner capacity of the particle accommodating unit 31 is relatively large) as in the present case. That is, in order to achieve the above-described effects of blocked toner breaking and falling towards the bottom portion by gravitational force when the disposition of the particle accommodating unit 31 is changed from the side face resting position (disposition during transportation) to the upright position (disposition during operations), the particle accommodating unit 31 has to be of an adequately size (have adequate toner capacity). Specifically, the particle accommodating unit 31 of the present embodiment having the above-described configuration is preferably arranged to have a width of at least 300 mm and a height of at least 300 mm so that a portion of blocked toner may easily break and fall towards the bottom portion when the disposition of the particle accommodating unit 31 is changed.

Referring to FIGS. 10A-10C, according to the present embodiment, the position of the first gripper 56, which is used for changing the disposition of the particle accommodating unit 31 from that during its transportation (see FIG. 10A) to that during operations (see FIG. 10B), is arranged to be distanced away from the resting face 31*d* on which the particle accommodating unit 31 rests during its transportation and is arranged close to the resting face 31*c* on which the particle accommodating unit 31 rests during operations. In this way, the particle accommodating unit 31 may be easily turned around one of the pairs of casters 31*a* as the pivot. The first gripper 56 is preferably arranged at both ends with respect to the width directions (i.e., directions perpendicular to the paper surface of FIGS. 10A-10C) in order to improve operability upon turning the particle accommodating unit 31. In this case, the first gripper 56 may be separately arranged at each width direction end portion of the particle accommodating unit 31, or the first gripper 56 may be one integral structure extending across the width directions of the particle accommodating unit 31 as is shown in FIG. 12B.

Also, according to the present embodiment, of the two pairs of casters 31*a* and 31*b* for supporting the particle accommodating unit 31 in an upright position and enabling it to move with respect to face 31*c* upon operations, one pair of casters 31*a* is arranged close to the region at which the face 31*d* intersects with the face 31*c*. In this way, the particle accommodating unit 31 may be easily turned around with respect to one of the pairs of casters 31*a* as the pivot.

Also, in the present embodiment, the wheel diameter of the pair of casters 31*a* corresponding to the pivot for rotating the particle accommodating unit 31 is arranged to be greater than the wheel diameter of the other pair of casters 31*b*. In this way, the particle accommodating unit 31 may be stably turned around the pair of casters 31*a* corresponding to the pivot.

Figure 12A:
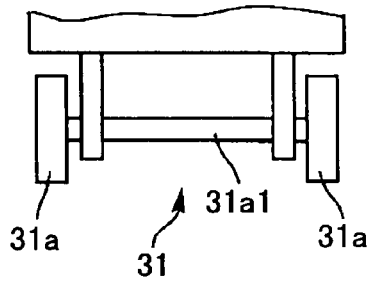
FIGS. 12A and 12B are diagrams showing configurations of casters arranged at the particle accommodating unit.
Figure 12B:
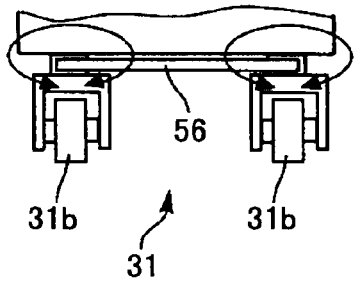

FIG. 12A is a diagram showing the pair of casters 31*a* corresponding to the rotational pivot of the particle accommodating unit 31 as viewed from the left side of FIG. 10C. FIG. 12B is a diagram showing the other pair of casters 31*b* as viewed from the right side of FIG. 10C.

As is shown in FIG. 12A, fixed casters are used for the pair of casters 31*a* corresponding to the rotational pivot of the particle accommodating unit 31. Specifically, the pair of casters 31*a* is coupled to an axle 31*a*1 and is configured to rotate in only one direction. In this way, the casters 31*a* may be prevented from rotating unstably (swiveling) when the particle accommodating unit 31 is turned with respect to the pair of caster 31*a* and stable rotating operations may be enabled. In one preferred embodiment, a lock mechanism (mechanism for locking the rotating wheels) may be arranged at the pair of casters 31*a* corresponding to the rotational pivot so that the rotating operations of the particle accommodating unit 31 may be further stabilized.

As is shown in FIG. 12B, movable casters having wheels that are able to rotate freely in any direction are used for the other pair of casters 31*b*. In this way, the particle accommodating unit 31 may be moved in any direction with respect to the resting face 31*c* on which the particle accommodating unit 31 rests during operations.

Also, as is shown in FIG. 10A, in the present embodiment, conveying means such as the suction tube 37 and the support 61 are arranged to be adequately distanced away from the resting face 31*d* on which the particle accommodating unit 31 rests during its transportation. In particular, the support 61 that supports the suction tube 37 and the remaining toner sensor 38 is preferably arranged toward the side face opposing the resting face 31*d* (upper face in FIG. 10A) at a position above the toner load line of the toner T at the time the particle accommodating unit 31 is being transported. In this way, the support may be prevented from being immersed in toner when the particle accommodating unit 31 is being transported so that the density of the toner particles may be prevented from increasing and toner blocking may be prevented.

Also, as is shown in FIG. 10A, in the present embodiment, the filter 35 (evacuation member) is preferably arranged above the toner load line at the time the particle accommodating unit 31 is being transported. In this way, the filter 35 may be prevented from being immersed in toner when the particle accommodating unit 31 is being transported so that the filter 35 may be prevented from being clogged with toner and filter functions of the filter 35 may be prevented from being degraded.

Also, in one preferred embodiment, a vibration controlling member may be arranged at the side face of the particle accommodating unit 31 (resting face 31*b* on which the particle accommodating unit 31 rests during its transportation). For example, polyurethane foam may be used as the vibration controlling member. In this way, toner blocking itself that occurs upon transportation of the particle accommodating unit 31 may be reduced.

As can be appreciated from the above descriptions, according to the present embodiment, air is spouted from the bottom of the particle accommodating unit 31 by the gas spouting unit 33 while the toner T within the particle accommodating unit 31 is introduced into the suction pipe 37 to be conveyed to the toner hopper 9 corresponding to the supply destination. In this way, the toner accommodating capacity may be increased without causing damage to the toner T or requiring complicated replacement procedures, fine adjustment of the toner supply amount may be performed, and the toner T may be efficiently and accurately transferred to the toner hopper 9 without causing the toner T to scatter, for example.

It is noted that in the present embodiment, the air pump 24 for supplying air to the gas spouting unit 33 and the second gas spouting unit 62 is positioned above the particle accommodating unit 31 of the particle supply apparatus main frame 21; however, the present invention is not limited to such an embodiment, and the air pump 24 may alternatively be positioned below the sloping surface of the particle accommodating unit 31, for example. In such a case, the length of the air conveying path for conveying air to the gas spouting unit 33 and the second gas spouting unit 62 may be reduced so that a pipe may be used instead of a (flexible) tube for forming the air conveying path, for example.

Also, in the present embodiment, the particle supply apparatus main frame 21 is arranged outside the imaging apparatus main frame 1; however, the particle supply apparatus main frame 21 may alternatively be arranged inside the imaging apparatus main frame 1. For example, the pump 22, the air pump 24, and the power supply unit 60 may be arranged inside the imaging apparatus main frame 1, and the particle accommodating unit 31 may be configured to be detachable with respect to the imaging apparatus main frame 1.

Second Embodiment

In the following, a second embodiment of the present invention is described with reference to FIGS. 13 and 14.

Figure 13:
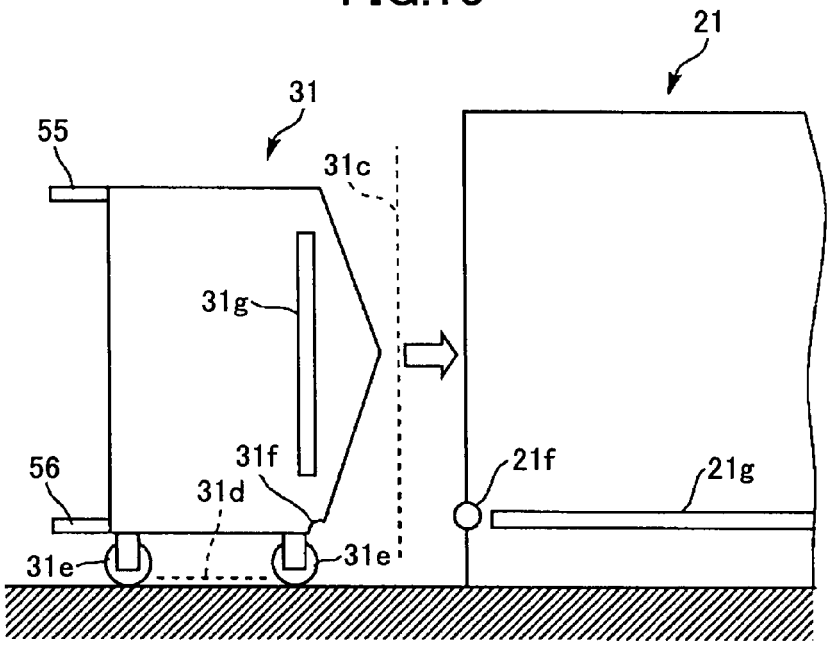
FIG. 13 is a diagram showing the disposition upon transportation of a particle accommodating unit according to a second embodiment of the present invention.
Figure 14:
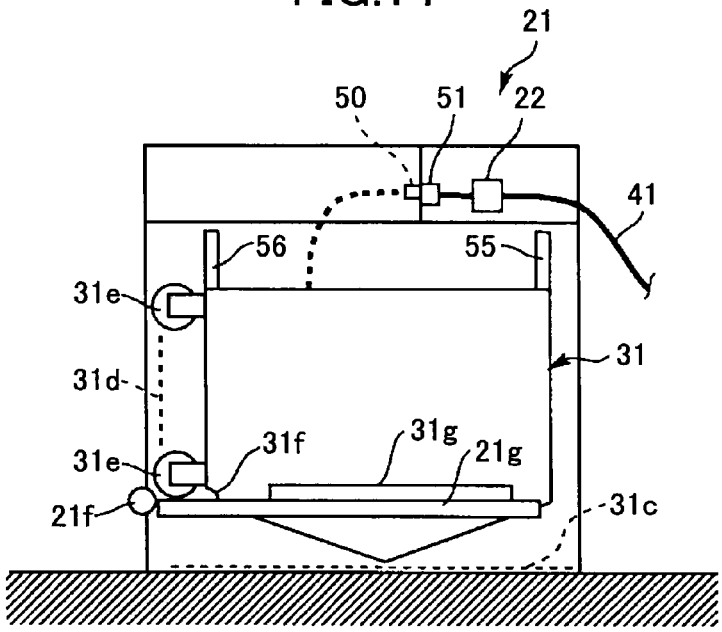
FIG. 14 is a diagram showing the disposition upon operation of the particle accommodating unit according to the second embodiment.

FIG. 13 is a diagram showing a disposition upon transportation of a particle accommodating unit 31 according to the second embodiment. FIG. 14 is a diagram showing the particle accommodating unit 31 of FIG. 13 being installed in a particle supply apparatus according to the second embodiment. It is noted that the particle supply apparatus according to the second embodiment differs from the first embodiment in that the particle accommodating unit 31 has casters 31*e* arranged on a face 31*d* corresponding to the resting face on which the particle accommodating unit 31 rests upon its transportation as opposed to having casters arranged on the resting face of the particle accommodating unit 31 during operation as in the first embodiment.

As is shown in FIG. 13, according to the second embodiment, plural pairs of casters 31*e* are arranged at the resting face 31*d* of the particle accommodating unit 31 during its transportation for enabling the particle accommodating unit 31 to be movably positioned upright with respect to the resting face 31*d*. It is noted that the particle accommodating unit 31 according to the present embodiment is arranged to stand on its side upon being transported as in the first embodiment. In this case, an operator may grip the second gripper 55 to easily move the particle accommodating unit 31 that is standing on its side via the casters 31*e*.

Also, the particle accommodating unit 31 according to the present embodiment includes an engaging portion 31*f* and a protruding portion 31*g*. The particle supply apparatus main frame 21 includes a pivot portion 21*f* and a guide portion 21*g* that engage the engaging portion 31*f* and the protruding portion 31*g*, respectively.

In the present embodiment, the particle accommodating unit 31 that is standing on its side may be moved toward the particle supply apparatus main frame 21 as is shown in FIG. 13 to have the engaging portion 31*f* engage the pivot portion 21*f* of the apparatus main frame 21. Then, the first gripper 56 may be held to rotate the particle accommodating unit 31 around the pivot portion 21*f* to engage the protruding portion 31*g* and the guide portion 21*g*. Then, the particle accommodating unit 31 may be inserted into the particle supply apparatus main frame 21 by sliding the protruding portion 31*g* on the guide portion 21*g*. In this way, the particle accommodating unit 31 may be loaded (installed) inside the particle supply apparatus main frame 21. At this point, the bottom face of the particle accommodating unit 31 corresponds to the resting face 31*c* on which the particle accommodating unit 31 rests during operation.

As can be appreciated from the above descriptions, in the second embodiment, the resting face 31*d* of the particle accommodating unit 31 during its transportation is arranged be different from the resting face 31*c* of the particle accommodating unit 31 during operation as in the first embodiment so that defective toner supply operations may be prevented from occurring in the particle supply apparatus according to the present embodiment even when toner blocking occurs within the particle accommodating unit 31 during its transportation.

Third Embodiment

In the following a third embodiment of the present invention is described with reference to FIGS. 15 and 16.

Figure 15:
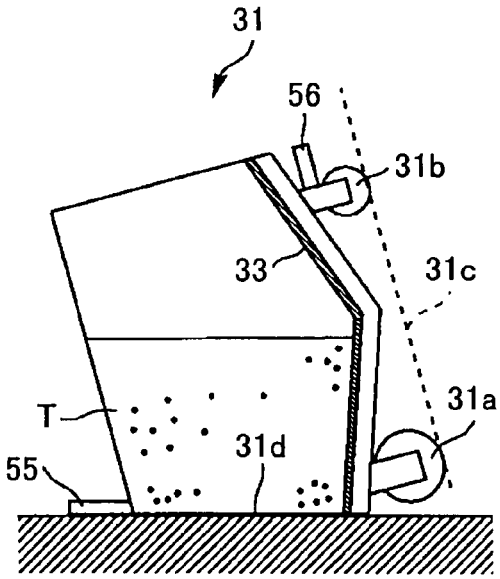
FIG. 15 is a diagram showing the disposition upon transportation of a particle accommodating unit according to a third embodiment of the present invention.

FIG. 15 is a diagram showing a disposition upon transportation of a particle accommodating unit 31 according to the third embodiment. FIG. 16 is a diagram showing a disposition upon operation of the particle accommodating unit 31 shown in FIG. 15. The particle supply apparatus according to the third embodiment differs from the first embodiment in that a resting face 31*d* on which the particle accommodating unit 31 rests upon its transportation is arranged to form an acute angle with a resting face 31*c* on which the particle accommodating unit 31 rests during operation.

Figure 16:
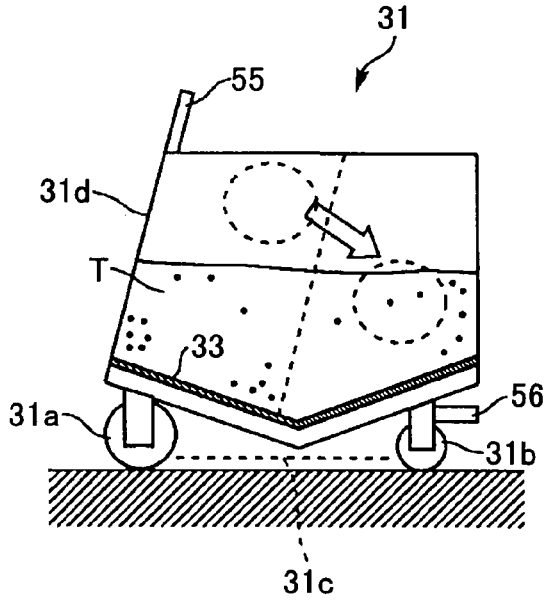
FIG. 16 is a diagram showing the disposition upon operation of the particle accommodating unit according to the third embodiment.

As is shown in FIGS. 15 and 16, the particle accommodating unit 31 according to the third embodiment is configured such that its resting face 31*d* during transportation is arranged to form an acute angle with its resting face 31*d* upon operation.

In this way, when the disposition of the particle accommodating unit 31 is changed from that upon transportation as is shown in FIG. 15 to that during operation as is shown in FIG. 16, toner T within the particle accommodating unit 31 including blocked toner generated during transportation may be slanted with respect to the resting face 31*c* (i.e., the upper portion of the toner may be inclined toward the resting face 31*c* as is indicated by the dashed line in FIG. 16). In this way, blocked toner may easily break and fall towards the resting face 31*c* (in the direction of the arrow shown in FIG. 16) immediately after the disposition of the particle accommodating unit 31 is changed. Thus, when gas is spouted from the gas spouting unit 33, fluidization of the fallen toner may be a trigger for inducing fluidization of the entire toner T accommodated within the particle accommodating unit 31.

As can be appreciated from the above descriptions, in the third embodiment, the resting face 31*d* of the particle accommodating unit 31 during its transportation is arranged be different from the resting face 31*c* of the particle accommodating unit 31 during operation as in the previously-described embodiments so that defective toner supply operations may be prevented from occurring in the particle supply apparatus according to the present embodiment even when toner blocking occurs within the particle accommodating unit 31 during its transportation.

Fourth Embodiment

In the following, a fourth embodiment of the present invention is described with reference to FIG. 17.

Figure 17:
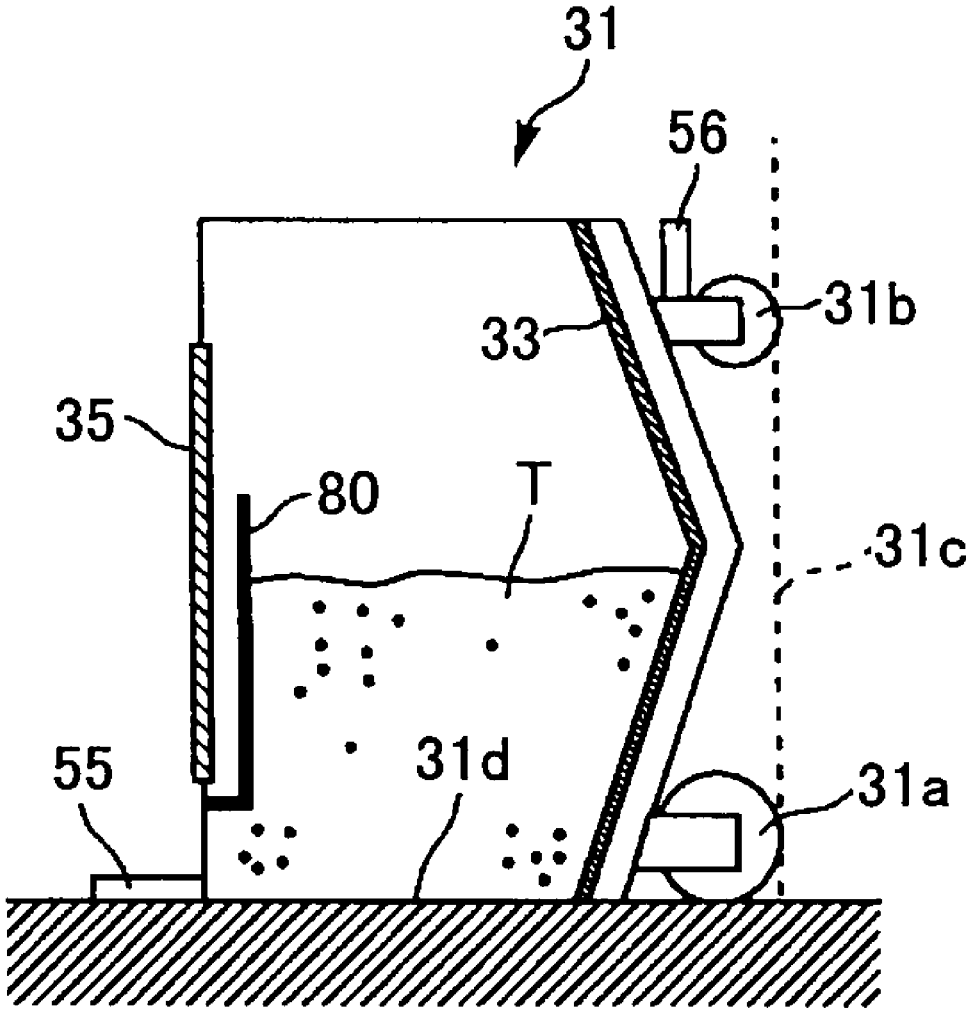
FIG. 17 is a diagram showing the disposition upon transportation of a particle accommodating unit according to a fourth embodiment of the present invention.

FIG. 17 is a diagram showing a disposition upon transportation of a particle accommodating unit 31 according to the fourth embodiment. The particle supply apparatus according to the fourth embodiment differs from the first embodiment in that the particle accommodating unit 31 includes a cover member 80.

As is shown in FIG. 17, the particle accommodating unit 31 according to the fourth embodiment includes a cover member 80 for covering the filter 35 so that it may be prevented from being immersed in toner T contained in the particle accommodating unit 80 when the particle accommodating unit 31 is disposed in its position for transportation. Specifically, the cover member 80 is arranged into a pouch having an upper portion upon transportation (opening) being positioned above the toner load line of the toner T during transportation of the particle accommodating unit 31. In this way, the filter 35 may be prevented from being immersed in toner and clogged to lose its function as a filter.

It is noted that in the present embodiment, a predetermined gap is secured between the filter 35 and the cover member 80 so that cases in which the cover member 80 blocks air from being discharged from the filter 35 may be prevented.

As can be appreciated, in the fourth embodiment, the resting face 31*d* of the particle accommodating unit 31 during its transportation is arranged be different from the resting face 31*c* of the particle accommodating unit 31 during operations as in the previously-described embodiments so that defective toner supply operations may be prevented from occurring in the particle supply apparatus according to the present embodiment even when toner blocking occurs within the particle accommodating unit 31 during its transportation.

Fifth Embodiment

In the following, a fifth embodiment of the present invention is described with reference to FIGS. 18A-18C.

Figure 18A:
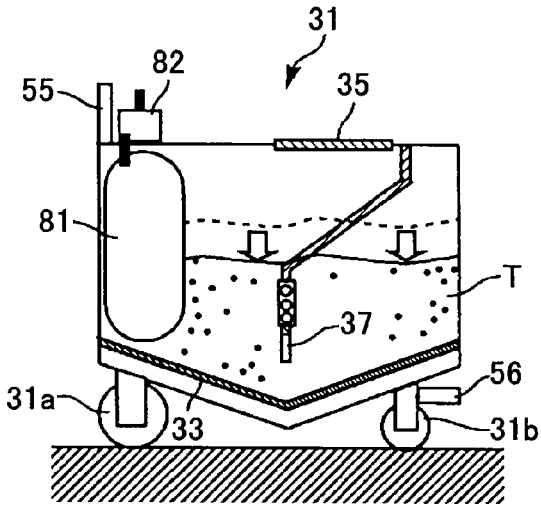
FIGS. 18A-18C are diagrams showing a particle accommodating unit according to a fifth embodiment of the present invention.
Figure 18B:
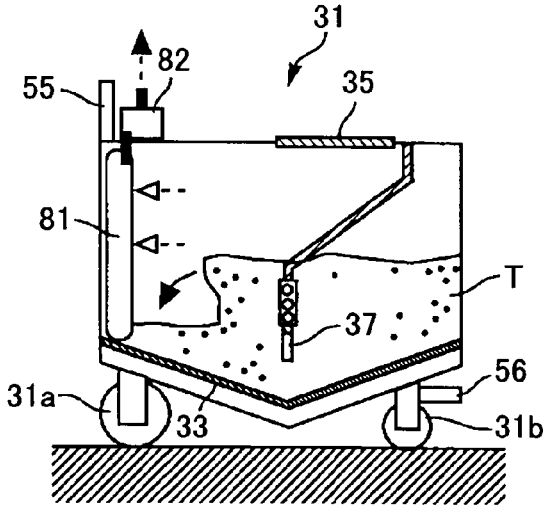
Figure 18C:
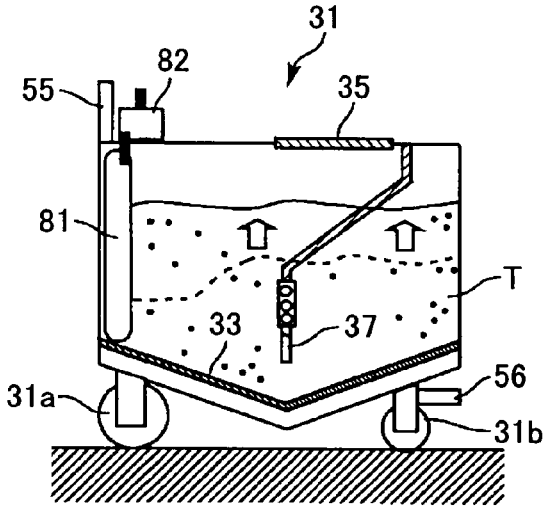

FIGS. 18A-18C are diagrams showing a particle accommodating unit 31 according to the fifth embodiment. It is noted that the particle accommodating unit 31 according to the fifth embodiment differs from that of the first embodiment in that it includes a gas accommodating pouch.

As is shown in FIGS. 18A-18C, the particle accommodating unit 31 according to the present embodiment has an air bag 81 arranged at a side face that intersects its bottom portion as a flexible gas accommodating pouch for accommodating gas therein. The air bag 81 is connected to an air valve 82 via a tube so that the air bag 81 may be expanded (i.e., increased in volume) by injecting air therein or contracted (i.e., reduced in volume) by discharging air therefrom.

As is shown in FIG. 18A, upon transporting the particle accommodating unit 31 (or upon performing toner replenishing operations thereon), the air bag 81 is filled with air and the air valve 82 is sealed. When the particle accommodating unit 31 is transported in an upright position with the air bag 81 filled with air in the above-described manner, the toner load line of the toner T accommodated in the particle accommodating unit 31 sinks to a lower level (in the direction indicated by the arrows shown in FIG. 18A) in accordance with the elapse of transporting time to eventually result in toner blocking.

Thus, according to the present embodiment, the seal of the air valve 82 is released as is shown in FIG. 18B right before the particle accommodating unit 31 is installed in the particle supply apparatus main frame 21 so that air may be discharged from the air bag 81 to cause its contraction (volume reduction) in the direction indicated by the white arrows shown in FIG. 18B. In response to such a reduction in volume of the air bag 81, a space is created within the blocked toner T to induce a portion of the blocked toner T to break and fall towards the space in the direction indicated by the solid line black arrow shown in FIG. 18B.

Then, as is shown in FIG. 18C, when gas is spouted from the gas spouting unit 33, fluidization of the fallen toner may be a trigger for inducing fluidization of the entire toner T accommodated in the particle accommodating unit 31 to thereby cause a change in the toner load line as is indicated by the arrows shown in FIG. 18C.

As can be appreciated from the above descriptions, in the fifth embodiment, the air bag 81 arranged within the particle accommodating unit 31 may be reduced in volume to cause a portion of blocked toner to break and fall so that defective toner supply operations may be prevented from occurring in the particle supply apparatus according to the present embodiment.

It is noted that in the above-described fifth embodiment, the bottom face of the particle accommodating unit 31 is arranged to be its resting face upon transportation. However, the resting face of the particle accommodating unit 31 upon its transportation may alternatively correspond to its side face as in the previously-described embodiments. In this case, by changing the disposition of the particle accommodating unit 31 to an upright position and reducing the volume of the air bag upon operation of the particle supply apparatus, portions of the particle accommodating unit 31 supporting the blocked toner may be reduced so that the blocked toner may break and fall more easily. In this way, defective toner supply operations may be prevented from occurring in the particle supply apparatus according to the present embodiment.

Sixth Embodiment

In the following, a sixth embodiment of the present invention is described with reference to FIGS. 19A and 19B.

Figure 19A:
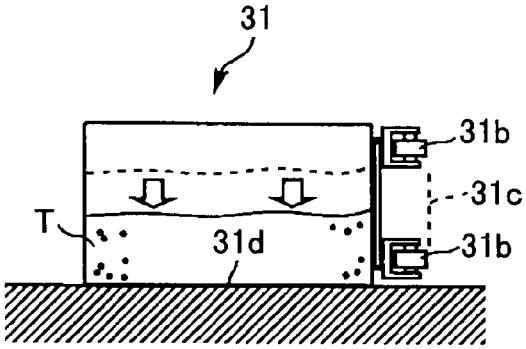
FIGS. 19A and 19B are diagrams showing a particle accommodating unit according to a sixth embodiment of the present invention.
Figure 19B:
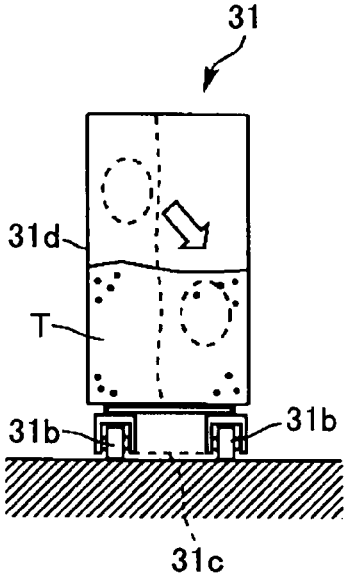

FIGS. 19A and 19B are diagrams showing a particle accommodating unit 31 according to the sixth embodiment. It is noted that the particle accommodating unit 31 according to the sixth embodiment differs from that of the first embodiment in that its resting face upon transportation corresponds to its side face extending in the width directions as opposed to a side face extending in the depth directions as in the first embodiment.

As is shown in FIG. 19A, in the sixth embodiment, the resting face 31*d* upon transportation of the particle accommodating unit 31 corresponds to a side face extending in the width directions of the particle accommodating unit 31 (side face perpendicular to the paper surface of FIGS. 19A and 19B). When the particle accommodating unit 31 is transported in this manner, the toner load line of the toner T accommodated in the particle accommodating unit 31 gradually sinks to a lower level (in the direction indicated by the arrow shown in FIG. 19A) in accordance with the elapse of transportation time to eventually result in toner blocking.

Then, when the particle accommodating unit 31 that is standing on its side face as is shown in FIG. 19A is positioned upright as is shown in FIG. 19B, a portion of the blocked toner T may break and fall in the direction indicated by the arrow shown in FIG. 19B. It is noted that by arranging the side face extending in the width directions to correspond to the resting face 31*d* of the particle accommodating unit 31 upon its transportation, the height of blocked toner with respect to the bottom surface of the particle accommodating unit 31 may be increased compared to the first embodiment so that breaking and falling of the upper portion of the blocked toner may be facilitated owing to the imbalance created upon changing the disposition of the particle accommodating unit 31.

As can be appreciated from the above descriptions, in the sixth embodiment, the resting face 31*d* of the particle accommodating unit 31 upon its transportation is arranged to be different from the resting face 31*c* of the particle accommodating unit 31 upon operations as in the previously-described embodiments so that even when toner blocking occurs within the particle accommodating unit 31 upon its transportation, defective toner supply operations may be prevented from occurring in the particle supply apparatus according to the present embodiment.

It is noted that the above-described preferred embodiments are exemplary applications of the present invention to a particle supply apparatus 20 that supplies toner to a supply destination. However, the present invention is not limited to such embodiments, and the present invention may equally be applied to a particle supply apparatus that supplies a two-component developer made up of a toner and a carrier to a supply destination, for example. In this case, a magnetic permeability sensor may be used as detection means for detecting the remaining amount of the two-component developer within the particle accommodating unit, for example.

Further, the present invention may be applied to other types of particle supply apparatuses including but not limited to the following:

(1) Particle supply apparatus (replenisher) for replenishing molding material (pellet) to a resin molding machine;

(2) Particle supply apparatus for conveying grain, fertilizer, animal fee, and the like;

(3) Particle supply apparatus used at a manufacturing plant for conveying medicine and other chemicals in powder form, liquid form, or tablet form;

(4) Particle supply apparatus for conveying cement;

(5) Particle supply apparatus for dispersing air into industrial paint to decrease its viscosity and conveying the same; and (6) Particle supply apparatus for conveying industrial glass beads used as material included in road paint and air beds, for example.

It is noted that in a case where the particle supply apparatus handles hard particles such as a two-component developer or glass beads, the gas spouting unit 33 (fluidized bed) may be prone to wear and damage over time and the pores of the porous member may be clogged when it is made of resin material such as PE or PC. Thus, in this case, the gas spouting unit 33 is preferably made of sintered copper, sintered iron, or a fine metal mesh filter, for example.

Also, it is noted that in the above-described embodiments of the present invention, a diaphragm air pump is used as the pump 22 for attracting toner within the particle accommodating unit 31 using suction force to discharge air towards the toner hopper 9. However, the present invention is not limited to such embodiments and other types of air pumps such as a screw pump (mono pump) may be used to obtain one or more of the above-described advantages of the present invention.

Also, it is noted that in the above-described embodiments of the present invention, the particle supply apparatus 20 is independently provided at that external side of the imaging apparatus 1. However, the particle supply apparatus 20 may also be provided as an integral unit within the imaging apparatus 1.

Further, the present invention is not limited to the above specifically disclosed embodiments, and variations and modifications may be made without departing from the scope of the present invention.

The present application is based on and claims the benefit of the priority date of Japanese Patent Application No. 2007-015208 filed on Jan. 25, 2007, the entire contents of which are hereby incorporated herein by reference.

What is claimed is:

1. A particle supply apparatus that supplies particles to a supply destination, the apparatus comprising:

a particle supply apparatus main frame;

a particle accommodating unit that accommodates the particles;

a gas spouting unit that is arranged at a bottom portion of the particle accommodating unit and is configured to spout gas toward the particles; and a conveying mechanism that applies suction to the particles accommodated in the particle accommodating unit and conveys the particles toward the supply destination;

wherein the particle accommodating unit is installed in the particle supply apparatus main frame and is arranged to rest on a first resting face at the bottom portion side during operation, and the particle accommodating unit is detached from the particle supply apparatus main frame and is arranged to rest on a second resting face other than the first resting face at the bottom portion side during transportation, and wherein the particle accommodating unit includes a plurality of pairs of casters for moving the particle accommodating unit in an upright position with respect to the first resting face of the particle accommodating unit during operation, and one of the pairs of casters is arranged close to an intersecting position between the second resting face of the particle accommodating unit during transportation and the first resting face of the particle accommodating unit during operation.

2. The particle supply apparatus as claimed in claim 1, wherein the particle accommodating unit includes a first gripper part for alternating a disposition of the particle accommodating unit between a disposition for transportation and a disposition for operation.

3. The particle supply apparatus as claimed in claim 2, wherein the first gripper part is arranged at a position that is distanced away from the second resting face of the particle accommodating unit during transportation and is close to the first resting face of the particle accommodating unit during operation.

4. The particle supply apparatus as claimed in claim 2, wherein the particle accommodating unit includes a second gripper part for attaching and detaching the particle accommodating unit with respect to the particle supply apparatus main frame.

5. The particle supply apparatus as claimed in claim 1, wherein a wheel diameter of said one of the pairs of casters is arranged to be greater than a wheel diameter of the other one or more pairs of casters.

6. The particle supply apparatus as claimed in claim 5, wherein said one pair of casters corresponds to a pair of fixed casters.

7. The particle supply apparatus as claimed in claim 6, wherein said one pair of casters includes a lock mechanism.

8. The particle supply apparatus as claimed in claim 1, wherein the particle accommodating unit includes a plurality of pairs of casters for moving the particle accommodating unit in an upright position with respect to the second resting face of the particle accommodating unit during transportation.

9. The particle supply apparatus as claimed in claim 1, wherein the second resting face of the particle accommodating unit during transportation is arranged to form an acute angle with respect to the first resting face of the particle accommodating unit during operation.

10. The particle supply apparatus as claimed in claim 1, wherein the particle accommodating unit includes a vibration controlling member arranged at the second resting face of the particle accommodating unit during transportation.

11. The particle supply apparatus as claimed in claim 1, wherein the conveying mechanism is arranged at a position that is distanced away from the second resting face of the particle accommodating unit during transportation.

12. The particle supply apparatus as claimed in claim 1, wherein the particle accommodating unit includes an evacuation member arranged at an upper face opposing the bottom portion for evacuating air contained in the particle accommodating unit; and the evacuation member is arranged to be positioned above a particle load line of the particles accommodated in the particle accommodating unit during transportation of the particle accommodating unit.

13. The particle supply apparatus as claimed in claim 1, wherein the particle accommodating unit includes an evacuation member arranged at an upper face opposing the bottom portion for evacuating air contained in the particle accommodating unit, and a cover member that covers the evacuation member and prevents the evacuation member from being immersed in the particles accommodated in the particle accommodating unit during transportation of the particle accommodating unit.

14. The particle supply apparatus as claimed in claim 1, wherein the particle accommodating unit includes a gas accommodating pouch arranged at the second resting face of the particle accommodating unit during transportation; and the gas accommodating pouch is configured to be reduced in volume by evacuating gas contained in the particle accommodating unit during operation.

15. The particle supply apparatus as claimed in claim 1, wherein the second resting face of the particle accommodating unit during transportation corresponds to a side face of the particle accommodating unit that intersects with the bottom portion of the particle accommodating unit.

16. The particle supply apparatus as claimed in claim 1, wherein the particle accommodating unit resting on the second face during transportation is turned around one of the pair of casters so that the particle accommodating unit stands in an upright position on the first resting face during operation.

17. The particle supply apparatus as claimed in claim 1, wherein the particle accommodating unit has a width of at least 300 mm and a height of at least 300 mm.

18. An imaging apparatus comprising:

a particle supply apparatus for supplying particles to a supply destination that includes a particle supply apparatus main frame;

a particle accommodating unit that accommodates the particles;

a gas spouting unit that is arranged at a bottom portion of the particle accommodating unit and is configured to spout gas toward the particles; and a conveying mechanism that applies suction to the particles accommodated in the particle accommodating unit and conveys the particles toward the supply destination;

wherein the particle accommodating unit is installed in the particle supply apparatus main frame and is arranged to rest on a first resting face at the bottom portion side during operation, and the particle accommodating unit is detached from the particle supply apparatus main frame and is arranged to rest on a second resting face other than the first resting face at the bottom portion side during transportation, and wherein the particle accommodating unit includes a plurality of pairs of casters for moving the particle accommodating unit in an upright position with respect to the first resting face of the particle accommodating unit during operation and one of the pairs of casters is arranged close to an intersecting position between the second resting face of the particle accommodating unit during transportation and the first resting face of the particle accommodating unit during operation.

19. A method of transporting a particle accommodating unit that is detachably arranged at a particle supply apparatus for supplying particles to a supply destination which particle accommodating unit is configured to accommodate the particles and has a gas spouting unit arranged at a bottom portion for spouting gas towards the particles, the method comprising:

arranging the particle accommodating unit in the particle supply apparatus main frame to rest on a first resting face at the bottom portion side of the particle accommodating unit during operation;

arranging the particle accommodating unit to be detached from the particle supply apparatus; and arranging the particle accommodating unit to rest on a second resting face other than the first face at the bottom portion side of the particle accommodating unit upon transporting the particle accommodating unit, wherein the particle accommodating unit includes a plurality of pairs of casters for moving the particle accommodating unit in an upright position with respect to the first resting face of the particle accommodating unit during operation and one of the pairs of casters is arranged close to an intersecting position between the second resting face of the particle accommodating unit during transportation and the first resting face of the particle accommodating unit during operation.

* * * * *